US009834905B2

(12) United States Patent
Matsuyama et al.

(10) Patent No.: US 9,834,905 B2
(45) Date of Patent: Dec. 5, 2017

(54) WORK MACHINE CONTROL DEVICE, WORK MACHINE, AND WORK MACHINE CONTROL METHOD

(71) Applicant: Komatsu Ltd., Tokyo (JP)

(72) Inventors: Toru Matsuyama, Naka-gun (JP); Masashi Ichihara, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 14/905,112

(22) PCT Filed: Sep. 25, 2015

(86) PCT No.: PCT/JP2015/077210
§ 371 (c)(1),
(2) Date: Jan. 14, 2016

(87) PCT Pub. No.: WO2016/035898
PCT Pub. Date: Mar. 10, 2016

(65) Prior Publication Data

US 2017/0089033 A1 Mar. 30, 2017

(51) Int. Cl.
*G06F 19/00* (2011.01)
*E02F 3/43* (2006.01)
(Continued)

(52) U.S. Cl.
CPC ..... *E02F 3/435* (2013.01); *E02F 3/32* (2013.01); *E02F 9/2025* (2013.01)

(58) Field of Classification Search
CPC ..... E02F 3/435; E02F 3/32
(Continued)

(56) References Cited

U.S. PATENT DOCUMENTS 4,627,013 A * 12/1986 Ichiyama ..... E02F 9/264 177/141
5,968,104 A * 10/1999 Egawa ..... E02F 3/435 37/414
(Continued)

FOREIGN PATENT DOCUMENTS

CN 104619922 A 5/2015
CN 104769189 A 7/2015
(Continued)

OTHER PUBLICATIONS

International Search Report and Written Opinion dated Dec. 15, 2015, issued for PCT/JP2015/077210.

*Primary Examiner* — Muhammad Shafi
(74) *Attorney, Agent, or Firm* — Locke Lord LLP

(57) ABSTRACT

A method of controlling a work machine including a working implement with a boom, an arm, and a bucket, includes: acquiring distance data between the bucket and a target excavating topography; determining a target blade tip speed of the bucket based on the distance data; calculating a target boom speed based on the target blade tip speed and at least one of an arm operation amount and a bucket operation amount; calculating a correction amount of the target boom speed based on an integration in time of a distance between the bucket and the target excavating topography; limiting the correction amount based on the distance between the bucket and the target excavating topography; and outputting an instruction for driving a boom cylinder driving the boom based on the target boom speed corrected by the correction amount.

9 Claims, 14 Drawing Sheets

(51) Int. Cl.
*E02F 3/32* (2006.01)
*E02F 9/20* (2006.01)

(58) Field of Classification Search
USPC ..... 701/50
See application file for complete search history.

(56) References Cited

U.S. PATENT DOCUMENTS

| | | | | |
|---|---|---|---|---|
| 7,610,136 | B2 * | 10/2009 | Okamura | E02F 9/2207 37/444 |
| 9,109,345 | B2 | 8/2015 | Okamura et al. | |
| 9,371,626 | B2 | 6/2016 | Kami et al. | |
| 9,464,406 | B2 | 10/2016 | Matsuyama et al. | |
| 9,481,976 | B2 | 11/2016 | Kami et al. | |
| 9,598,845 | B2 | 3/2017 | Baba et al. | |

FOREIGN PATENT DOCUMENTS

| | | | |
|---|---|---|---|
| JP | 2005-256595 | A | 9/2005 |
| JP | 5654144 | B1 | 1/2015 |
| JP | 5807120 | B1 | 11/2015 |
| KR | 10-2003-0084048 | A | 11/2003 |
| WO | WO-2010/101233 | A1 | 9/2010 |
| WO | WO-2014/167718 | A1 | 10/2014 |

* cited by examiner

WORK MACHINE CONTROL DEVICE, WORK MACHINE, AND WORK MACHINE CONTROL METHOD

FIELD

The present invention relates to a work machine control device, a work machine, and a work machine control method.

BACKGROUND

In a technical field related with a work machine such as an excavator, as disclosed in Patent Literature 1, there is known a work machine that controls a working implement so that a blade tip of a bucket moves along a target excavating topography (a design surface) indicating a target shape of an excavation target.

In the specification, a control for causing the blade tip of the bucket of the working implement to move along the target excavating topography will be referred to as a leveling assist control. In the leveling assist control, a target blade tip speed of the bucket is determined from a distance between the target excavating topography and the current blade tip position of the bucket, and the determined target blade tip speed is added to the blade tip speed counteracting the blade tip speed of the bucket in response to at least one of the arm operation amount and the bucket operation amount by the operator. Then, a target boom speed is calculated from the added value. Further, the target boom speed is corrected (compensated by integration) by using a correction amount obtained by the integration in time of the distance between the target excavating topography and the past blade tip position of the bucket, and the boom cylinder is controlled based on the target boom speed compensated by integration. In the leveling assist control using the compensation by integration, the boom cylinder is controlled so that the boom is raised when the blade tip of the bucket digs the target excavating topography.

CITATION LIST

Patent Literature

Patent Literature 1: WO 2014/167718 A

SUMMARY

Technical Problem

In the excavator, a time delay exists in the responsiveness of a hydraulic cylinder with respect to a control signal for controlling the hydraulic cylinder due to a delay in the responsiveness of hydraulic pressure or hysteresis generated when driving a hydraulic driving unit. Particularly, a delay in the responsiveness of the hydraulic cylinder noticeably occurs when the hydraulic cylinder is operated from an acceleration state to a deceleration state. For that reason, when the ratio of the correction amount using the compensation by integration is large, overcompensation occurs. As a result, a phenomenon occurs in which the blade tip of the bucket is excessively separated from the target excavating topography.

For example, in a case where the boom is raised by the leveling assist control in which the blade tip of the bucket returns to the target excavating topography from the state where the blade tip of the bucket digs the target excavating topography, when the time in which the blade tip of the bucket exceeds the target excavating topography is long, the correction amount is excessively large when the blade tip of the bucket returns to the target excavating topography. Thus, when the boom is operated from an acceleration state to a deceleration state, the target boom speed is not decreased and the boom is excessively raised. Accordingly, a phenomenon occurs in which the blade tip of the bucket is excessively raised from the target excavating topography. As a result, a portion which is not excavated by the working implement is generated, and hence the leveling operation is performed in a state different from the target excavating topography.

An aspect of the invention is to provide a work machine control device, a work machine, and a work machine control method capable of suppressing degradation in excavating precision by preventing the blade tip from being raised until the blade tip of the bucket returns to the target excavating topography from the state where the blade tip digs the target excavating topography in the leveling assist control.

Solution to Problem

According to a first aspect of the present invention, a work machine control device for a work machine including a working implement with a boom, an arm, and a bucket, comprises: a distance acquiring unit which acquires distance data between the bucket and a target excavating topography; a target blade tip speed determining unit which determines a target blade tip speed of the bucket based on the distance data; an operation amount acquiring unit which acquires an operation amount for operating the working implement; a target boom speed calculating unit which calculates a target boom speed based on the target blade tip speed and at least one of an arm operation amount and a bucket operation amount acquired by the operation amount acquiring unit; a correction amount calculating unit which calculates a correction amount of the target boom speed based on an integration in time of a distance between the bucket and the target excavating topography; a correction amount limiting unit which limits the correction amount based on the distance between the bucket and the target excavating topography; and a working implement control unit which outputs an instruction for driving a boom cylinder driving the boom based on the target boom speed corrected by the correction amount.

According to a second aspect of the present invention, a work machine comprises: a working implement which includes a boom, an arm, and a bucket; a boom cylinder which drives the boom; an arm cylinder which drives the arm; a bucket cylinder which drives the bucket; an upper swing body which supports the working implement; a lower traveling body which supports the upper swing body; and a control device, wherein the control device includes a distance acquiring unit which acquires distance data between the bucket and a target excavating topography, a target blade tip speed determining unit which determines a target blade tip speed of the bucket based on the distance data, an operation amount acquiring unit which acquires an operation amount for operating the working implement, a target boom speed calculating unit which calculates a target boom speed based on the target blade tip speed and at least one of an arm operation amount and a bucket operation amount acquired by the operation amount acquiring unit, a correction amount calculating unit which calculates a correction amount of the target boom speed based on an integration in time of a distance between the bucket and the target excavating topography, a correction amount limiting unit which limits the correction amount based on the distance between the bucket and the target excavating topography, and a working implement control unit which outputs an instruction for driving the boom cylinder based on the target boom speed corrected by the correction amount.

According to a third aspect of the present invention, a method of controlling a work machine including a working implement with a boom, an arm, and a bucket, comprises: acquiring distance data between the bucket and a target excavating topography; determining a target blade tip speed of the bucket based on the distance data; calculating a target boom speed based on the target blade tip speed and at least one of an arm operation amount and a bucket operation amount; calculating a correction amount of the target boom speed based on an integration in time of a distance between the bucket and the target excavating topography; limiting the correction amount based on the distance between the bucket and the target excavating topography; and outputting an instruction for driving a boom cylinder driving the boom based on the target boom speed corrected by the correction amount.

Advantageous Effects of Invention

According to the aspect of the invention, it is possible to provide a work machine control device, a work machine, and a work machine control method capable of suppressing degradation in excavating precision by preventing the blade tip from being raised until the blade tip of the bucket returns to the target excavating topography from the state where the blade tip digs the target excavating topography in the leveling assist control.

DESCRIPTION OF EMBODIMENTS

Hereinafter, embodiments according to the invention will be described with reference to the drawings, but the invention is not limited thereto. The components of the embodiments to be described below can be appropriately combined with one another. Further, there is a case where a part of the components are not used.

[Work Machine]

Figure 1:
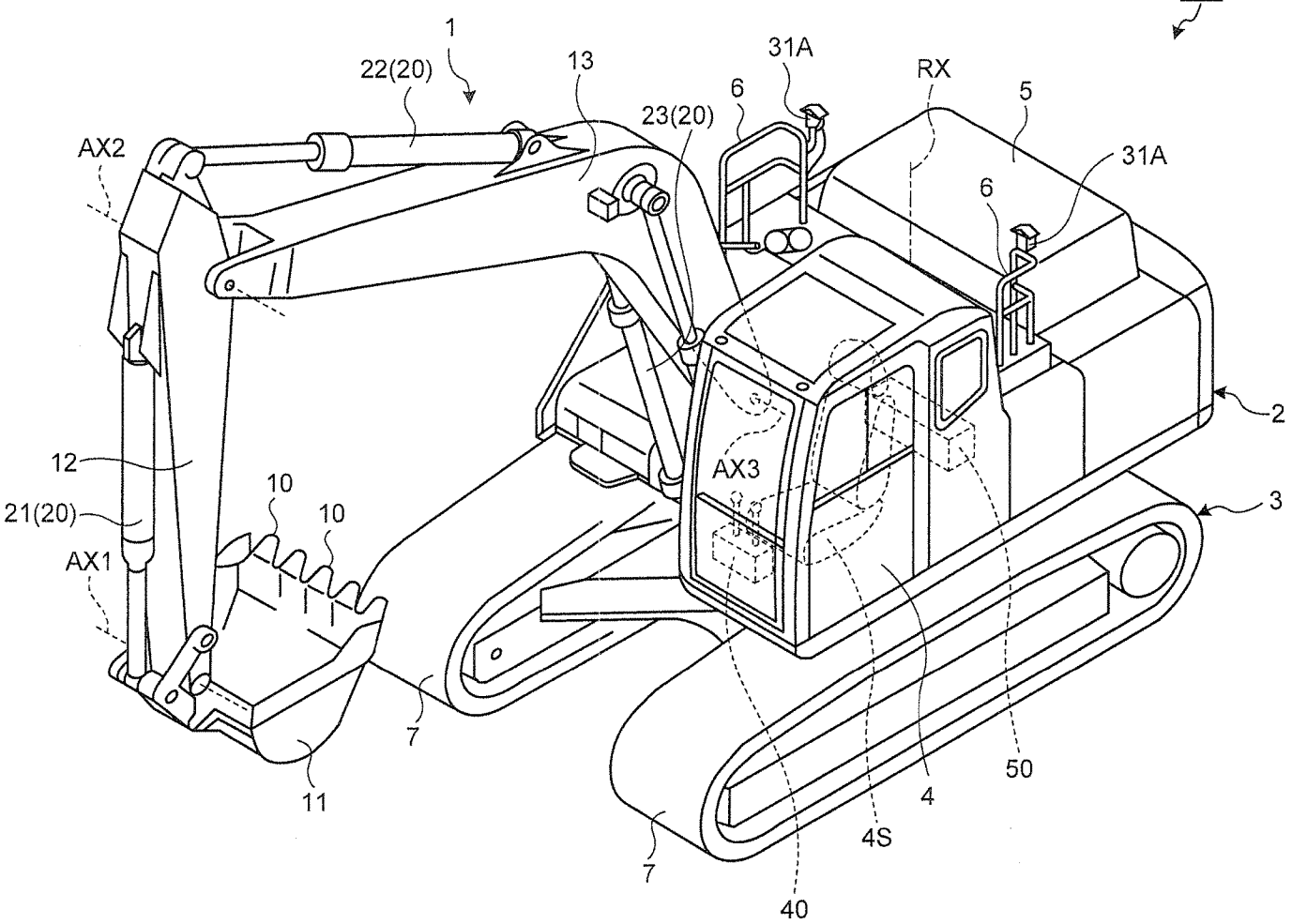
FIG. 1 is a perspective view illustrating an example of an excavator according to an embodiment.

FIG. 1 is a perspective view illustrating an example of a work machine 100 according to an embodiment. In the embodiment, an example will be described in which the work machine 100 is an excavator. In the description below, the work machine 100 will be appropriately referred to as the excavator 100.

As illustrated in FIG. 1, the excavator 100 includes a working implement 1 which is operated by a hydraulic pressure, a vehicle body 2 which supports the working implement 1, a traveling device 3 which supports the vehicle body 2, an operation device 40 which is used to operate the working implement 1, and a control device 50 which controls the working implement 1. The vehicle body 2 is able to swing about a swing axis RX while being supported by the traveling device 3. The vehicle body 2 is disposed on the traveling device 3. In the description below, the vehicle body 2 will be appropriately referred to as the upper swing body 2, and the traveling device 3 will be appropriately referred to as the lower traveling body 3.

The upper swing body 2 includes a cab 4 which is occupied by an operator, a machine room 5 which accommodates an engine or a hydraulic pump, and a handrail 6. The cab 4 includes a driver seat 4S on which the operator sits. The machine room 5 is disposed in rear of the cab 4. The handrail 6 is disposed in front of the machine room 5.

The lower traveling body 3 includes a pair of crawlers 7. By the rotation of the crawlers 7, the excavator 100 travels. In addition, the lower traveling body 3 may be vehicle wheels (tires).

The working implement 1 is supported by the upper swing body 2. The working implement 1 includes a bucket 11 having a blade tip 10, an arm 12 connected to the bucket 11, and a boom 13 connected to the arm 12. The blade tip 10 of the bucket 11 may be a protruding blade tip provided in the bucket 11. The blade tip 10 of the bucket 11 may be a straight blade tip provided in the bucket 11.

The bucket 11 and the arm 12 are connected to each other through a bucket pin. The bucket 11 is supported by the arm 12 so as to be rotatable about the rotation axis AX1. The arm 12 and the boom 13 are connected to each other through an arm pin. The arm 12 is supported by the boom 13 so as to be rotatable about the rotation axis AX2. The boom 13 and the upper swing body 2 are connected to each other through a boom pin. The boom 13 is supported by the vehicle body 2 so as to be rotatable about the rotation axis AX3.

The rotation axis AX1, the rotation axis AX2, and the rotation axis AX3 are parallel to one another. The rotation axes AX1, AX2, and AX3 are orthogonal to an axis parallel to the swing axis RX. In the description below, the axial direction of each of the rotation axes AX1, AX2, and AX3 will be appropriately referred to as the vehicle width direction of the upper swing body 2, and the direction orthogonal to the rotation axes AX1, AX2, and AX3 and the swing axis RX will be appropriately referred to as the front to back direction of the upper swing body 2. A direction in which the working implement 1 exists based on the operator sitting on the driver seat 4S will be set as the front direction.

In addition, the bucket 11 may be a tilt bucket. The tilt bucket is a bucket which is able to be tilted in the vehicle width direction by the operation of the bucket tilt cylinder. When the excavator 100 is operated in a slope, it is possible to freely mold and level a slope or an even ground by tilting the bucket 11 in the vehicle width direction.

The operation device 40 is disposed in the cab 4. The operation device 40 includes an operation member that is operated by the operator of the excavator 100. The operation member includes an operation lever or a joystick. By the operation of the operation member, the working implement 1 is operated.

The control device 50 includes a computer system. The control device 50 includes a processor such as a CPU (Central Processing Unit), a storage device such as a ROM (Read Only Memory) or a RAM (Random Access Memory), and an input/output interface device.

Figure 2:
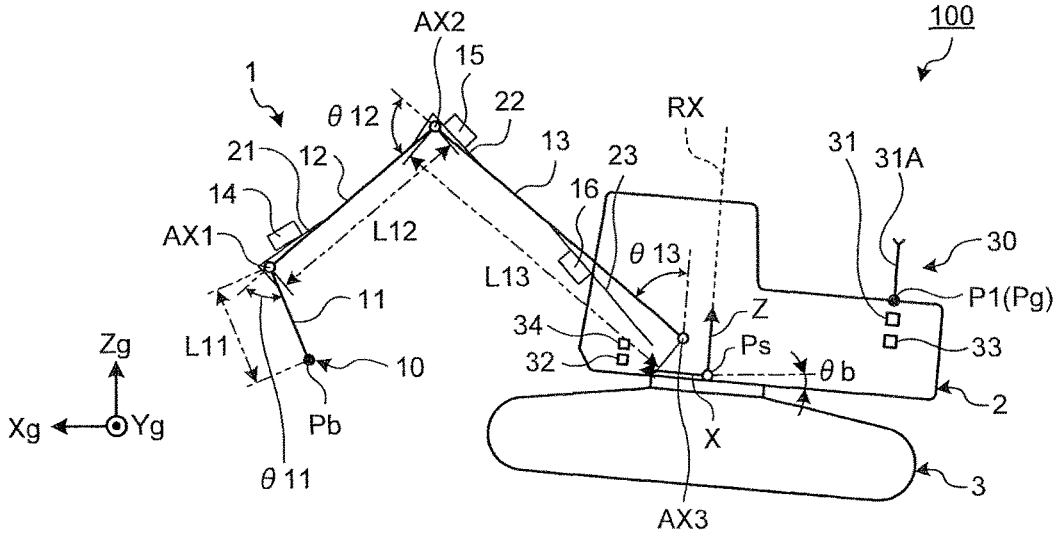
FIG. 2 is a schematic side view illustrating an example of the excavator according to the embodiment.
Figure 3:
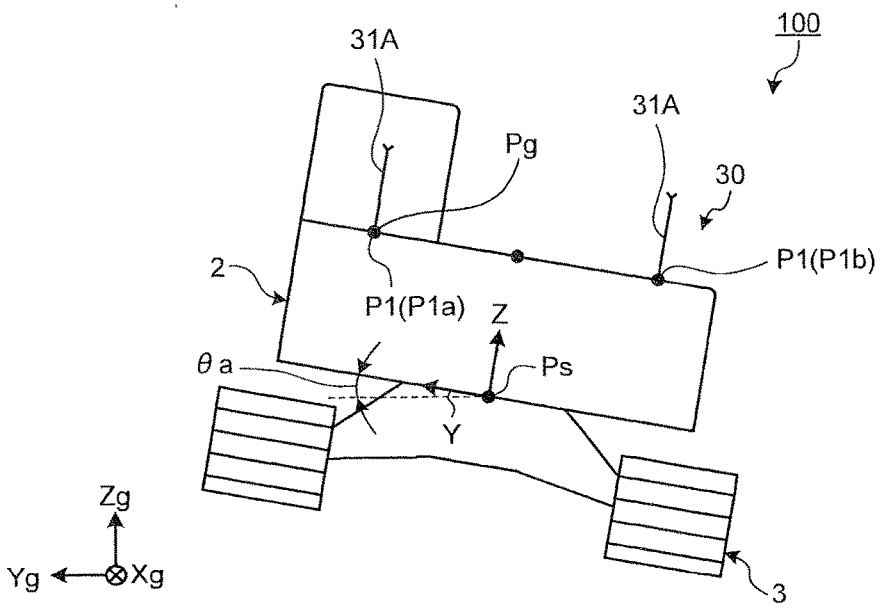
FIG. 3 is a schematic rear view illustrating an example of the excavator according to the embodiment.

FIG. 2 is a schematic side view illustrating the excavator 100 according to the embodiment. FIG. 3 is a schematic rear view illustrating the excavator 100 according to the embodiment.

As illustrated in FIGS. 1 and 2, the excavator 100 includes a hydraulic cylinder 20 which drives the working implement 1. The hydraulic cylinder 20 is driven by hydraulic oil. The hydraulic cylinder 20 includes a bucket cylinder 21 which drives the bucket 11, an arm cylinder 22 which drives the arm 12, and a boom cylinder 23 which drives the boom 13.

As illustrated in FIG. 2, the excavator 100 includes a bucket cylinder stroke sensor 14 disposed in the bucket cylinder 21, an arm cylinder stroke sensor 15 disposed in the arm cylinder 22, and a boom cylinder stroke sensor 16 disposed in the boom cylinder 23. The bucket cylinder stroke sensor 14 detects the bucket cylinder length as the stroke length of the bucket cylinder 21. The arm cylinder stroke sensor 15 detects the arm cylinder length as the stroke length of the arm cylinder 22. The boom cylinder stroke sensor 16 detects the boom cylinder length as the stroke length of the boom cylinder 23.

As illustrated in FIGS. 2 and 3, the excavator 100 includes a position detector 30 which detects the position of the upper swing body 2. The position detector 30 includes a vehicle body position detector 31 which detects the position of the upper swing body 2 defined by a global coordinate system, a posture detector 32 which detects the posture of the upper swing body 2, and a direction detector 33 which detects the direction of the upper swing body 2.

The global coordinate system (the XgYgZg coordinate system) is a coordinate system that indicates an absolute position defined by a GPS (Global Positioning System). The local coordinate system (the XYZ coordinate system) is a coordinate system that indicates a relative position based on the reference position Ps of the upper swing body 2 of the excavator 100. The reference position Ps of the upper swing body 2 is set in, for example, the swing axis RX of the upper swing body 2. In addition, the reference position Ps of the upper swing body 2 may be set in the rotation axis AX3. By the position detector 30, the three-dimensional position of the upper swing body 2 defined by the global coordinate system, the inclination angle of the upper swing body 2 with respect to the horizontal plane, and the direction of the upper swing body 2 with respect to the reference direction are detected.

The vehicle body position detector 31 includes a GPS receiver. The vehicle body position detector 31 detects the three-dimensional position of the upper swing body 2 defined by the global coordinate system. The vehicle body position detector 31 detects the Xg-direction position, the Yg-direction position, and the Zg-direction position of the upper swing body 2.

The upper swing body 2 is provided with a plurality of GPS antennas 31A. The GPS antennas 31A are provided in the handrail 6 of the upper swing body 2. In addition, the GPS antenna 31A may be disposed on the counter weight disposed in rear of the machine room 5. The GPS antennas 31A receive radio waves from a GPS satellite and output signals based on the received radio waves to the vehicle body position detector 31. The vehicle body position detector 31 detects the installation positions P1 of the GPS antennas 31A defined by the global coordinate system based on the signals supplied from the GPS antennas 31A. The vehicle body position detector 31 detects the absolute position Pg of the upper swing body 2 based on the installation positions P1 of the GPS antennas 31A.

Two GPS antennas 31A are provided in the vehicle width direction. The vehicle body position detector 31 detects the installation position Pla of one GPS antenna 31A and the installation position Plb of the other GPS antenna 31A. The vehicle body position detector 31A detects the absolute position Pg and the direction of the upper swing body 2 by performing a calculation process based on the installation position P1*a* and the installation position P1*b*. In the embodiment, the absolute position Pg of the upper swing body 2 is the installation position P1*a*. In addition, the absolute position Pg of the upper swing body 2 may be also the installation position P1*b*.

The posture detector 32 includes an IMU (Inertial Measurement Unit). The posture detector 32 is provided in the upper swing body 2. The posture detector 32 is disposed at the lower portion of the cab 4. The posture detector 32 detects the inclination angle of the upper swing body 2 with respect to the horizontal plane (the XgYg plane). The inclination angle of the upper swing body 2 with respect to the horizontal plane includes the inclination angle θa of the upper swing body 2 in the vehicle width direction and the inclination angle θb of the upper swing body 2 in the front to back direction.

The direction detector 33 has a function of detecting the direction of the upper swing body 2 in the reference direction defined by the global coordinate system based on the installation position P1*a* of one GPS antenna 31A and the installation position P1*b* of the other GPS antenna 31A. The reference direction indicates, for example, north. The direction detector 33 detects the direction of the upper swing body 2 with respect to the reference direction by performing a calculation process based on the installation position P1*a* and the installation position P1*b*. The direction detector 33 calculates a line connecting the installation position P1*a* and the installation position P1*b*, and detects the direction of the upper swing body 2 with respect to the reference direction based on the angle formed between the calculate line and the reference direction.

In addition, the direction detector 33 may be separated from the position detector 30. The direction detector 33 may detect the direction of the upper swing body 2 by using a magnetic sensor.

The excavator 100 includes a blade tip position detector 34 which detects the relative position of the blade tip 10 with respect to the reference position Ps of the upper swing body 2.

In the embodiment, the blade tip position detector 34 calculates the relative position of the blade tip 10 with respect to the reference position Ps of the upper swing body 2 based on the detection result of the bucket cylinder stroke sensor 14, the detection result of the arm cylinder stroke sensor 15, the detection result of the boom cylinder stroke sensor 16, the length L11 of the bucket 11, the length L12 of the arm 12, and the length L13 of the boom 13.

The blade tip position detector 34 calculates the inclination angle θ11 of the blade tip 10 of the bucket 11 with respect to the arm 12 based on the bucket cylinder length detected by the bucket cylinder stroke sensor 14. The blade tip position detector 34 detects the inclination angle θ12 of the arm 12 with respect to the boom 13 based on the arm cylinder length detected by the arm cylinder stroke sensor 15. The blade tip position detector 34 calculates the inclination angle θ13 of the boom 13 with respect to the Z axis of the upper swing body 2 based on the boom cylinder length detected by the boom cylinder stroke sensor 16.

The length L11 of the bucket 11 is a distance between the blade tip 10 of the bucket 11 and the rotation axis AX1 (the bucket pin). The length L12 of the arm 12 is a distance between the rotation axis AX1 (the bucket pin) and the rotation axis AX2 (the arm pin). The length L13 of the boom 13 is a distance between the rotation axis AX2 (the arm pin) and the rotation axis AX3 (the boom pin).

The blade tip position detector 34 calculates the relative position of the blade tip 10 with respect to the reference position Ps of the upper swing body 2 based on the inclination angle θ11, the inclination angle θ12, the inclination angle θ13, the length L11, the length L12, and the length L13.

Further, the blade tip position detector 34 calculates the absolute position Pb of the blade tip 10 based on the absolute position Pg of the upper swing body 2 detected by the position detector 30 and the relative position between the reference position Ps of the upper swing body 2 and the blade tip 10. The relative position between the absolute position Pg and the reference position Ps is given data derived from the specification data of the excavator 100. Thus, the blade tip position detector 34 can calculate the absolute position Pb of the blade tip 10 based on the absolute position Pg of the upper swing body 2, the relative position between the reference position Ps of the upper swing body 2 and the blade tip 10, and the specification data of the excavator 100.

In addition, the blade tip position detector 34 may include an angle sensor such as a potentiometer and an angle meter. The angle sensor may be used to detect the inclination angle θ11 of the bucket 11, the inclination angle θ12 of the arm 12, and the inclination angle θ13 of the boom 13.

[Leveling Assist Control]

Figure 4:
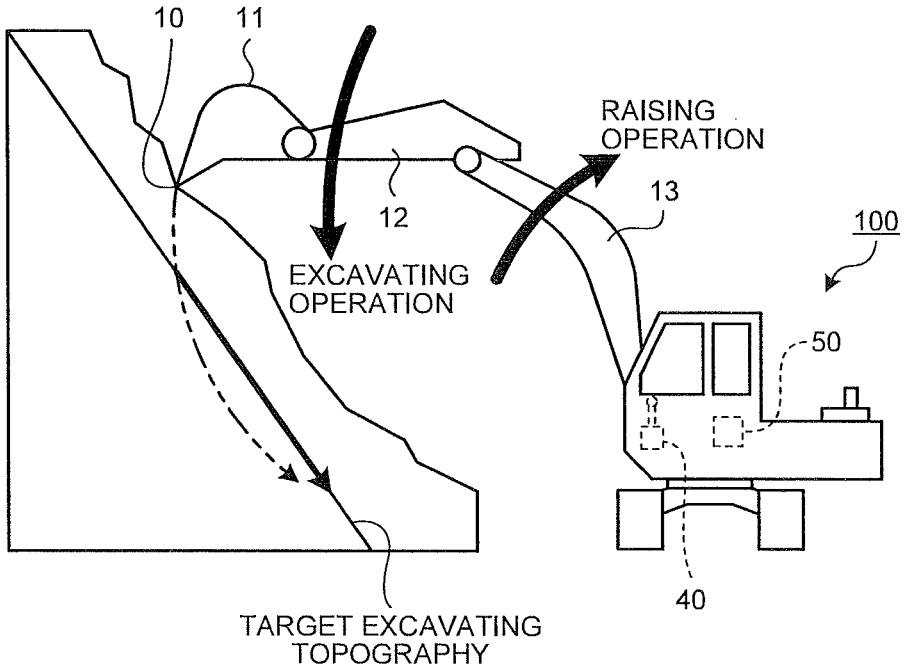
FIG. 4 is a schematic view illustrating a leveling assist control according to the embodiment.

FIG. 4 is a schematic view illustrating the operation of the excavator 100 according to the embodiment. In the embodiment, the control device 50 performs a leveling assist control on the working implement 1 so that the blade tip 10 of the bucket 11 moves along the target excavating topography (the design surface) indicating the target shape of the excavation target. The control device 50 performs a leveling assist control on the working implement 1 by, for example, a PI control (proportional-integral control).

By the operation of the operation device 40, the dumping operation of the bucket 11, the excavating operation of the bucket 11, the dumping operation of the arm 12, the excavating operation of the arm 12, the raising operation of the boom 13, and the lowering operation of the boom 13 are performed.

In the embodiment, the operation device 40 includes a right operation lever disposed at the right side of the operator sitting on the driver seat 4S and a left operation lever disposed at the left side thereof. When the right operation lever is operated in the front to back direction, the lowering operation and the raising operation of the boom 13 are performed. When the right operation lever is operated in the left and right direction (the vehicle width direction), the excavating operation and the dumping operation of the bucket 11 are performed. When the left operation lever is operated in the front to back direction, the dumping operation and the excavating operation of the arm 12 are performed. When the left operation lever is operated in the left and right direction, the upper swing body 2 swings left and right. In addition, when the left operation lever is operated in the front to back direction, the upper swing body 2 may swing right and left. Then when the left operation lever is operated in the left and right direction, the arm 12 may perform the dumping operation and the excavating operation.

In the leveling assist control, the bucket 11 and the arm 12 are driven based on the operation of the operation device 40 by the operator. The boom 13 is driven based on at least one of the operator's operation of the operation device 40 and the control of the control device 50.

As illustrated in FIG. 4, when the excavation target is excavated, the bucket 11 and the arm 12 are used to perform the excavating operation. The control device 50 performs a control related with the movement of the boom 10 so that the blade tip 10 of the bucket 11 moves along the target excavating topography while the bucket 11 and the arm 12 are used for the excavating operation by the operation of the operation device 40. In the example illustrated in FIG. 4, the control device 50 controls the boom cylinder 23 so that the boom 13 is raised while the bucket 11 and the arm 12 are used for the excavating operation.

[Hydraulic System]

Next, an example of a hydraulic system 300 according to the embodiment will be described. The hydraulic cylinder 20 including the bucket cylinder 21, the arm cylinder 22, and the boom cylinder 23 is operated by the hydraulic system 300. The hydraulic cylinder 20 is operated by the operation device 40.

In the embodiment, the operation device 40 is a pilot hydraulic operation device. In the description below, the oil supplied to the hydraulic cylinder 20 in order to operate the hydraulic cylinder 20 (the bucket cylinder 21, the arm cylinder 22, and the boom cylinder 23) will be appropriately referred to as the hydraulic oil. The hydraulic oil supply amount with respect to the hydraulic cylinder 20 is adjusted by a direction control valve 41. The direction control valve 41 is operated by the supplied oil. In the description below, the oil supplied to the direction control valve 41 in order to operate the direction control valve 41 will be appropriately referred to as the pilot oil. Further, the pressure of the pilot oil will be appropriately referred to as the pilot hydraulic pressure.

Figure 5:
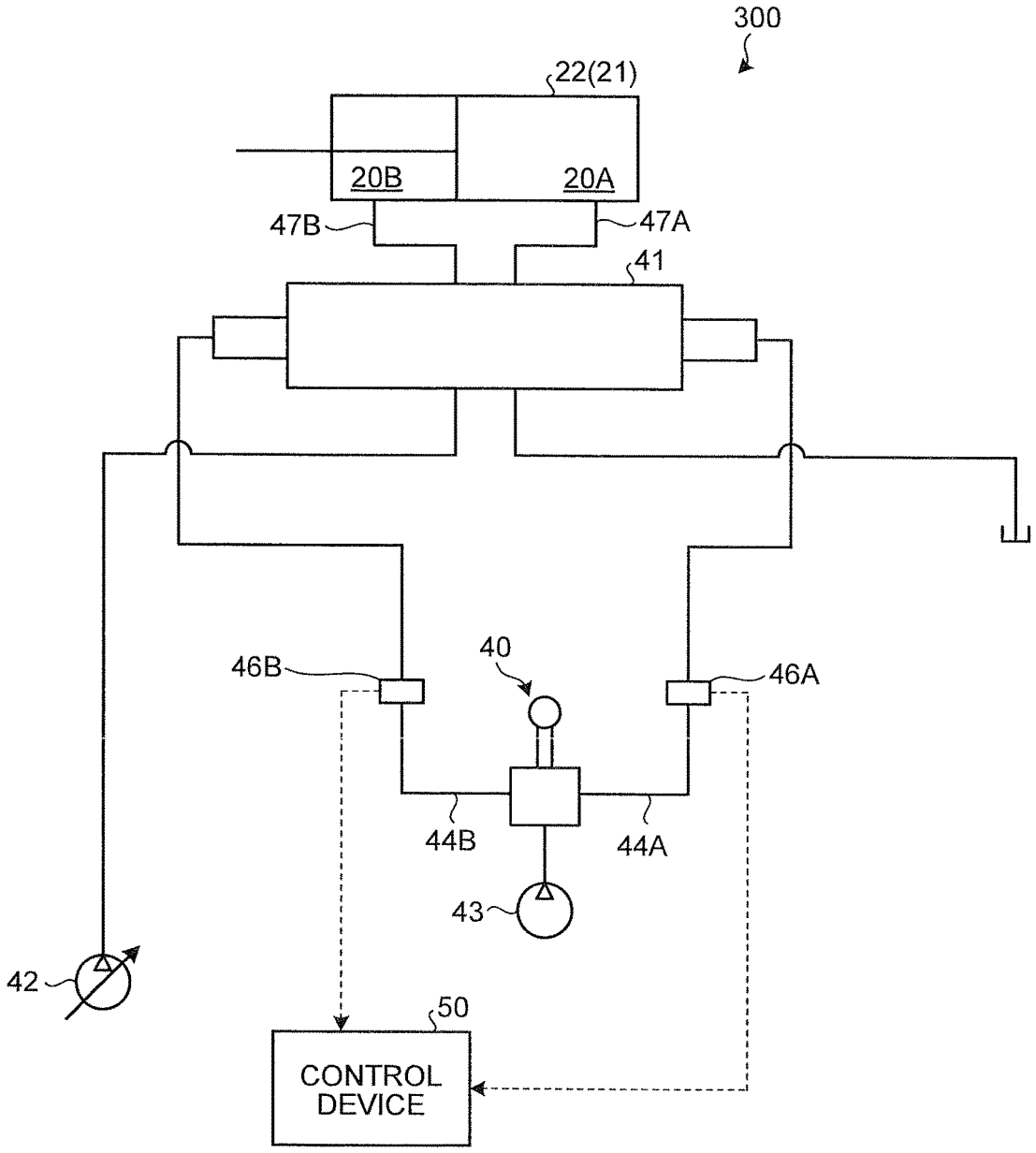
FIG. 5 is a schematic view illustrating an example of a hydraulic system according to the embodiment.

FIG. 5 is a schematic view illustrating an example of the hydraulic system 300 operated by the arm cylinder 22. By the operation of the operation device 40, the arm 12 performs two kinds of operations, the excavating operation and the dumping operation. When the arm cylinder 22 is lengthened, the arm 12 performs the excavating operation. Then, when the arm cylinder 22 is shortened, the arm 12 performs the dumping operation.

The hydraulic system 300 includes a variable displacement main hydraulic pump 42 which supplies the hydraulic oil to the arm cylinder 22 through the direction control valve 41, a pilot hydraulic pump 43 which supplies the pilot oil, the operation device 40 which adjusts the pilot hydraulic pressure with respect to the direction control valve 41, oil passages 44A and 44B through which the pilot oil flows, pressure sensors 46A and 46B respectively disposed in the oil passages 44A and 44B, and the control device 50. The main hydraulic pump 42 is driven by a motor such as an engine (not illustrated).

The direction control valve 41 controls the hydraulic oil flow direction. The hydraulic oil supplied from the main hydraulic pump 42 is supplied to the arm cylinder 22 through the direction control valve 41. The direction control valve 41 is of a spool type that changes the hydraulic oil flow direction by moving a rod-shaped spool. When the spool moves in the axial direction, the supply of the hydraulic oil with respect to a cap side oil chamber 20A (an oil passage 47A) of the arm cylinder 22 and the supply of the hydraulic oil with respect to a rod side oil chamber 20B (an oil passage 47B) thereof are switched. In addition, the cap side oil chamber 20A is a space which is formed between a cylinder head cover and a piston. The rod side oil chamber 20B is a space in which a piston rod is disposed. Further, when the spool moves in the axial direction, the hydraulic oil supply amount (the supply amount per unit time) with respect to the arm cylinder 22 is adjusted. When the hydraulic oil supply amount with respect to the arm cylinder 22 is adjusted, the cylinder speed is adjusted.

The direction control valve 41 is operated by the operation device 40. The pilot oil fed from the pilot hydraulic pump 43 is supplied to the operation device 40. In addition, the pilot oil which is fed from the main hydraulic pump 42 and is decreased in pressure by a pressure reduction valve may be supplied to the operation device 40. The operation device 40 includes a pilot hydraulic pressure adjusting valve. Based on the operation amount of the operation device 40, the pilot hydraulic pressure is adjusted. By the pilot hydraulic pressure, the direction control valve 41 is driven. When the pilot hydraulic pressure is adjusted by the operation device 40, the movement amount and the movement speed of the spool in the axial direction are adjusted.

The direction control valve 41 includes a first pressure receiving chamber and a second pressure receiving chamber. When the spool is driven by the pilot hydraulic pressure of the oil passage 44A, the first pressure receiving chamber is connected to the main hydraulic pump 42 so that the hydraulic oil is supplied to the first pressure receiving chamber. When the spool is driven by the pilot hydraulic pressure of the oil passage 44B, the second pressure receiving chamber is connected to the main hydraulic pump 42 so that the hydraulic oil is supplied to the second pressure receiving chamber.

The pressure sensor 46A detects the pilot hydraulic pressure of the oil passage 44A. The pressure sensor 46B detects the pilot hydraulic pressure of the oil passage 44B. The detection signals of the pressure sensors 46A and 46B are output to the control device 50.

When the operation lever of the operation device 40 is operated toward one side in relation to the neutral position, the pilot hydraulic pressure set in response to the operation amount of the operation lever acts on the first pressure receiving chamber of the spool of the direction control valve 41. When the operation lever of the operation device 40 is operated toward the other side in relation to the neutral position, the pilot hydraulic pressure set in response to the operation amount of the operation lever acts on the second pressure receiving chamber of the spool of the direction control valve 41.

The spool of the direction control valve 41 moves by the distance set in response to the pilot hydraulic pressure adjusted by the operation device 40. For example, when the pilot hydraulic pressure acts on the first pressure receiving chamber, the hydraulic oil is supplied from the main hydraulic pump 42 to the cap side oil chamber 20A of the arm cylinder 22 so that the arm cylinder 22 is lengthened. When the arm cylinder 22 is lengthened, the arm 12 performs the excavating operation. When the pilot hydraulic pressure acts on the second pressure receiving chamber, the hydraulic oil is supplied from the main hydraulic pump 42 into the rod side oil chamber 20B of the arm cylinder 22 so that the arm cylinder 22 is shortened. When the arm cylinder 22 is shortened, the arm 12 performs the dumping operation. Based on the movement amount of the spool of the direction control valve 41, the hydraulic oil supply amount per unit time supplied from the main hydraulic pump 42 to the arm cylinder 22 through the direction control valve 41 is adjusted. When the hydraulic oil supply amount per unit time is adjusted, the cylinder speed is adjusted.

The hydraulic system 300 that operates the bucket cylinder 21 has the same configuration as the hydraulic system 300 that operates the arm cylinder 22. By the operation of the operation device 40, the bucket 11 performs two kinds of operations, the excavating operation and the dumping operation. When the bucket cylinder 21 is lengthened, the bucket 11 performs the excavating operation. When the bucket cylinder 21 is shortened, the bucket 11 performs the dumping operation. The detailed description of the hydraulic system 300 operating the bucket cylinder 21 will be omitted.

Figure 6:
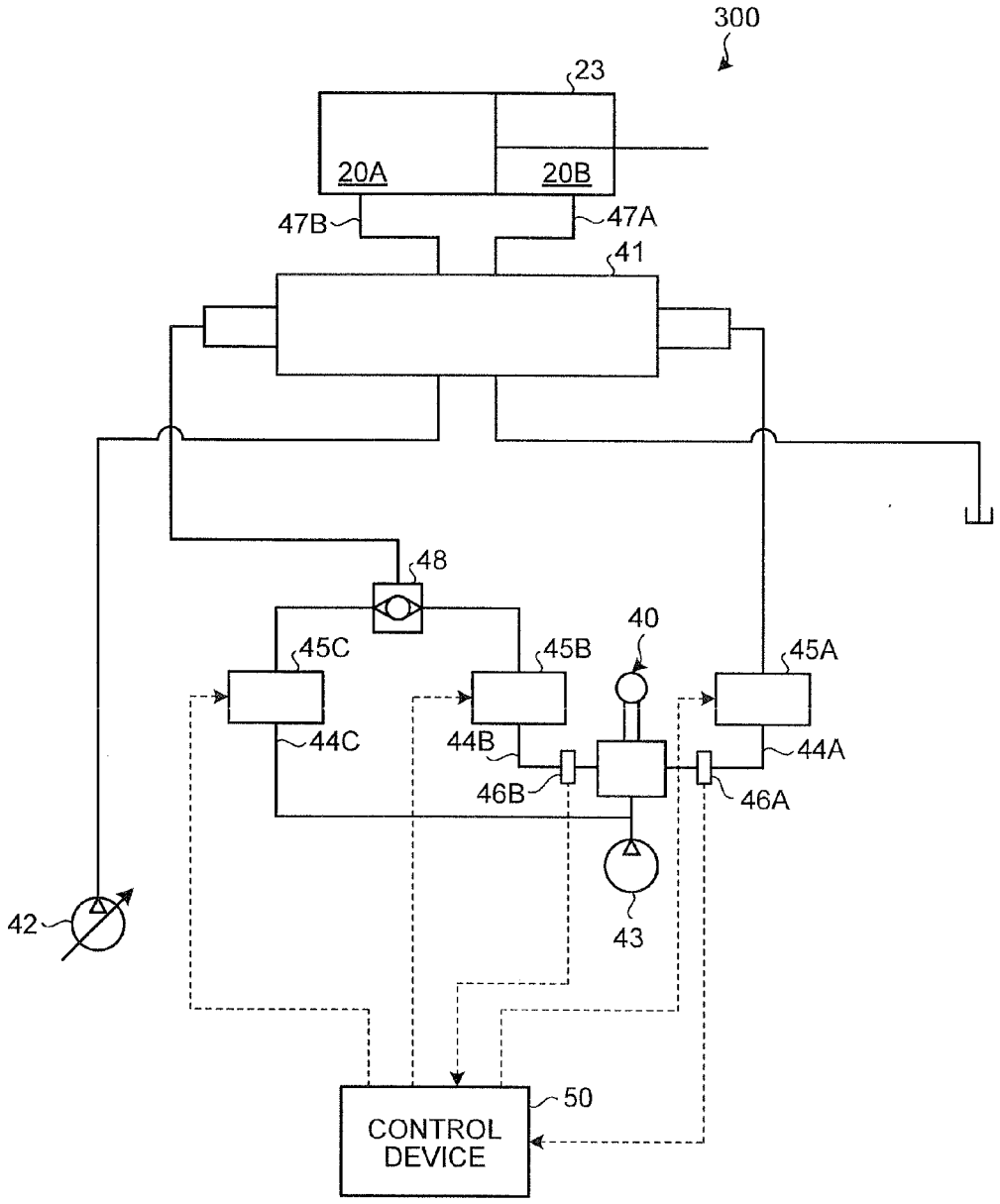
FIG. 6 is a schematic view illustrating an example of the hydraulic system according to the embodiment.

FIG. 6 is a schematic view illustrating an example of the hydraulic system 300 operating the boom cylinder 23. By the operation of the operation device 40, the boom 13 performs two kinds of operations, the raising operation and the lowering operation. The direction control valve 41 includes a first pressure receiving chamber and a second pressure receiving chamber. When the spool is driven by the pilot hydraulic pressure of the oil passage 44A, the first pressure receiving chamber is connected to the main hydraulic pump 42 so that the hydraulic oil is supplied to the first pressure receiving chamber. When the spool is driven by the pilot hydraulic pressure of the oil passage 44B, the second pressure receiving chamber is connected to the main hydraulic pump 42 so that the hydraulic oil is supplied to the second pressure receiving chamber. The hydraulic oil supplied from the main hydraulic pump 42 is supplied to the boom cylinder 23 through the direction control valve 41. When the spool of the direction control valve 41 moves in the axial direction, the supply of the hydraulic oil with respect to the cap side oil chamber 20A (the oil passage 47B) of the boom cylinder 23 and the supply of the hydraulic oil with respect to the rod side oil chamber 20B (the oil passage 47A) thereof are switched. When the hydraulic oil is supplied to the first pressure receiving chamber, the hydraulic oil is supplied to the rod side oil chamber 20B through the oil passage 47A so that the boom cylinder 13 is shortened and the boom 13 is lowered. When the hydraulic oil is supplied to the second pressure receiving chamber, the hydraulic oil is supplied to the cap side oil chamber 20A through the oil passage 47B so that the boom cylinder 13 is lengthened and the boom 13 is raised.

As illustrated in FIG. 6, the hydraulic system 300 operating the boom cylinder 23 includes the main hydraulic pump 42, the pilot hydraulic pump 43, the direction control valve 41, the operation device 40 adjusting the pilot hydraulic pressure for the direction control valve 41, the oil passages 44A, 44B, and 44C causing the pilot oil to flow therethrough, control valves 45A, 45B, and 45C disposed in the oil passages 44A, 44B, and 44C, the pressure sensors 46A and 46B disposed in the oil passages 44A, 44B, and 44C, and the control device 50 controlling the control valves 45A, 45B, and 45C.

The control valves 45A, 45B, and 45C are electromagnetic proportional control valves. The control valves 45A, 45B, and 45C adjust the pilot hydraulic pressure based on the instruction signal from the control device 50. The control valve 45A adjusts the pilot hydraulic pressure of the oil passage 44A. The control valve 45B adjusts the pilot hydraulic pressure of the oil passage 44B. The control valve 45C adjusts the pilot hydraulic pressure of the oil passage 44C.

As described above by referring to FIG. 5, the pilot hydraulic pressure set in response to the operation amount of the operation device 40 acts on the direction control valve 41 by the operation of the operation device 40. The spool of the direction control valve 41 moves in response to the pilot hydraulic pressure. Based on the movement amount of the spool, the hydraulic oil supply amount per unit time supplied from the main hydraulic pump 42 to the boom cylinder 23 through the direction control valve 41 is adjusted.

The control device 50 can decrease the pilot hydraulic pressure acting on the first pressure receiving chamber by controlling the control valve 45A. The control device 50 can decrease the pilot hydraulic pressure acting on the second pressure receiving chamber by controlling the control valve 45B. In the example illustrated in FIG. 6, when the pilot hydraulic pressure adjusted by the operation of the operation device 40 is decreased by the control valve 45A, the pilot oil supplied to the direction control valve 41 is limited. When the pilot hydraulic pressure acting on the direction control valve 41 is decreased by the control valve 45A, the lowering operation of the boom 13 is limited. Similarly, when the pilot hydraulic pressure adjusted by the operation of the operation device 40 is decreased by the control valve 45B, the pilot oil supplied to the direction control valve 41 is limited. When the pilot hydraulic pressure acting on the direction control valve 41 is decreased by the control valve 45B, the raising operation of the boom 13 is limited. The control device 50 controls the control valve 45A based on the detection signal of the pressure sensor 46A. The control device 50 controls the control valve 45B based on the detection signal of the pressure sensor 46B.

In the embodiment, the oil passage 44C is provided with the control valve 45C which is operated based on the instruction signal related with the leveling assist control and output from the control device 50 for the leveling assist control. The pilot oil fed from the pilot hydraulic pump 43 flows in the oil passage 44C. The oil passage 44C and the oil passage 44B are connected to a shuttle valve 48. The shuttle valve 48 supplies the pilot oil of the oil passage having a higher pilot hydraulic pressure among the oil passage 44B and the oil passage 44C to the direction control valve 41.

The control valve 45C is controlled based on the instruction signal output from the control device 50 for the leveling assist control.

The control device 50 does not output the instruction signal to the control valve 45C so that the direction control valve 41 is driven based on the pilot hydraulic pressure adjusted by the operation of the operation device 40 when the leveling assist control is not performed. For example, the control device 50 fully opens the control valve 45B and closes the oil passage 44C by the control valve 45C so that the direction control valve 41 is driven based on the pilot hydraulic pressure adjusted by the operation of the operation device 40.

When the leveling assist control is performed, the control device 50 controls the control valves 45B and 45C so that the direction control valve 41 is driven based on the pilot hydraulic pressure adjusted by the control valve 45C. For example, when the leveling assist control of limiting the movement of the boom 13 is performed, the control device 50 controls the control valve 45C so as to realize the pilot hydraulic pressure in response to the target boom speed. For example, the control device 50 controls the control valve 45C so that the pilot hydraulic pressure adjusted by the control valve 45C becomes higher than the pilot hydraulic pressure adjusted by the operation device 40. When the pilot hydraulic pressure of the oil passage 44C becomes higher than the pilot hydraulic pressure of the oil passage 44B, the pilot oil is supplied from the control valve 45C to the direction control valve 41 through the shuttle valve 48.

When the pilot oil is supplied to the direction control valve 41 through at least one of the oil passage 44B and the oil passage 44C, the hydraulic oil is supplied to the cap side oil chamber 20A through the oil passage 47B. Accordingly, the boom cylinder 23 is lengthened so that the boom 13 is raised.

When the raising operation amount of the boom 13 caused by the operation device 40 is large so that the target excavating topography is not dug by the blade tip 10 of the bucket 11, the leveling assist control is not performed. When the operation device 40 is operated so that the boom 13 is raised at a speed faster than the target boom speed and the pilot hydraulic pressure is adjusted based on the operation amount, the pilot hydraulic pressure adjusted by the operation of the operation device 40 becomes higher than the pilot hydraulic pressure adjusted by the control valve 45C. Accordingly, the pilot oil of the pilot hydraulic pressure adjusted by the operation of the control valve 45C of the control device 50 is selected by the shuttle valve 48 and is supplied to the direction control valve 41. Further, when the pilot hydraulic pressure set based on the instruction from the control device 50 to be described later to the control valve 45C is lower than the pilot hydraulic pressure based on the boom operation amount, the pilot oil adjusted by the operation of the operation device 40 is selected by the shuttle valve 48 and the boom 13 is operated.

[Control System]

Figure 7:
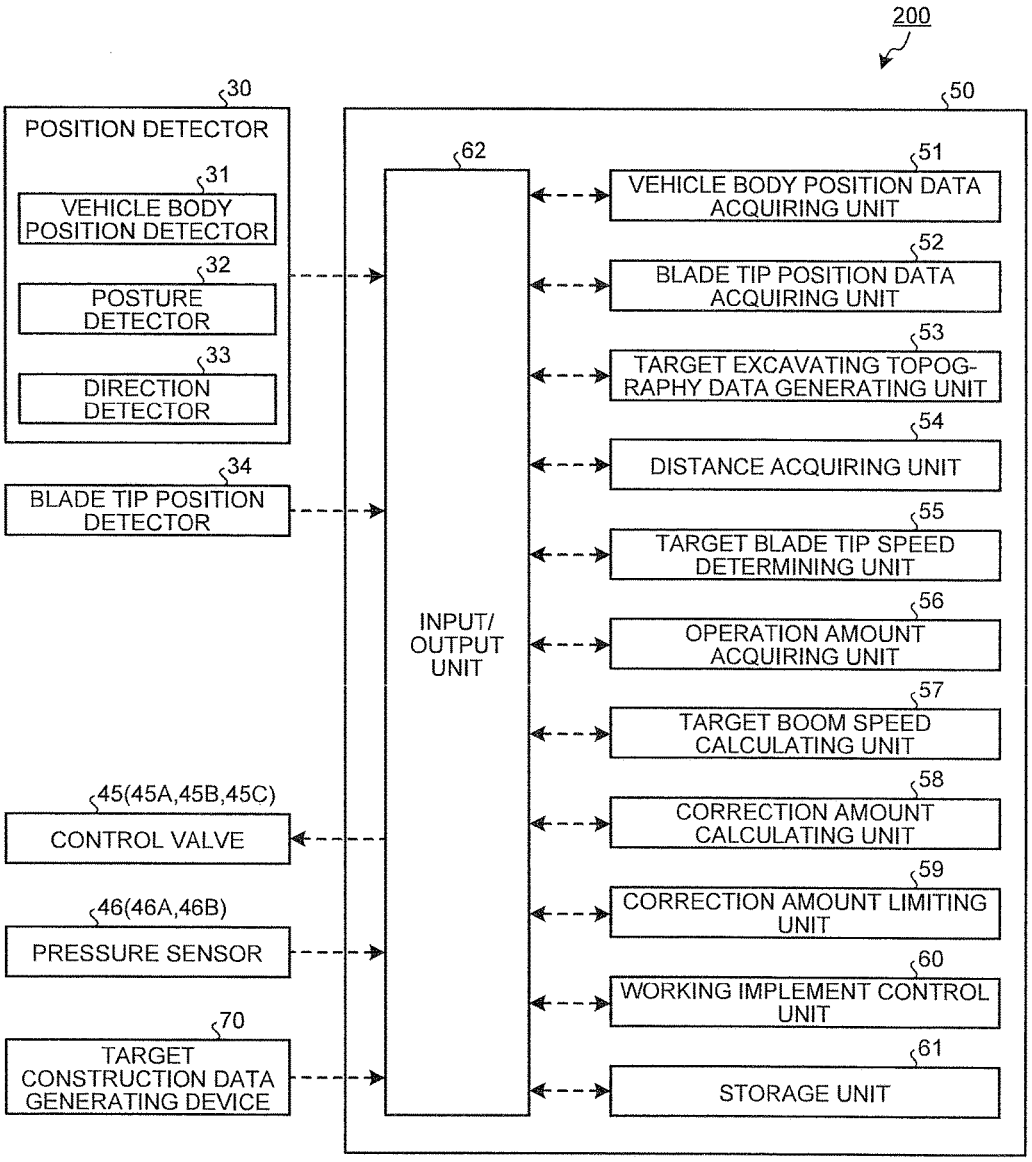
FIG. 7 is a functional block diagram illustrating an example of a control system according to the embodiment.

Next, a control system 200 of the excavator 100 according to the embodiment will be described. FIG. 7 is a functional block diagram illustrating an example of the control system 200 according to the embodiment.

As illustrated in FIG. 7, the control system 200 includes the control device 50 controlling the working implement 1, the position detector 30, the blade tip position detector 34, the operation device 40, the control valve 45 (45A, 45B, and 45C), a pressure sensor 46 (46A and 46B), and a target construction data generating device 70.

As described above, the position detector 30 including the vehicle body position detector 31, the posture detector 32, and the direction detector 33 detects the absolute position Pg of the upper swing body 2. In the description below, the absolute position Pg of the upper swing body 2 will be appropriately referred to as the vehicle body position Pg.

The control valve 45 (45A, 45B, and 45C) adjusts the hydraulic oil supply amount with respect to the hydraulic cylinder 20. The control valve 45 is operated based on the instruction signal from the control device 50. The pressure sensor 46 (46A and 46B) detects the pilot hydraulic pressure of an oil passage 44 (44A and 44B). The detection signal of the pressure sensor 46 is output to the control device 50.

The target construction data generating device 70 includes a computer system. The target construction data generating device 70 generates target construction data indicating a three-dimensional design topography as the target shape of the construction area. The target construction data indicates the three-dimensional target shape obtained after the construction by the working implement 1. The target construction data includes coordinate data and angle data necessary for generating the target excavating topography data.

The target construction data generating device 70 is provided in, for example, a remote place separated from the excavator 100. The target construction data generating device 70 is provided in, for example, a construction management facility. A radio communication can be allowed between the target construction data generating device 70 and the control device 50. The target construction data generated by the target construction data generating device 70 is wirelessly transmitted to the control device 50.

In addition, the target construction data generating device 70 and the control device 50 may be connected via a wire so that the target construction data is transmitted from the target construction data generating device 70 to the control device 50. In addition, the target construction data generating device 70 may include a storage medium storing the target construction data and the control device 50 may include a device capable of reading the target construction data from the storage medium.

The control device 50 includes a vehicle body position data acquiring unit 51 which acquires vehicle body position data indicating the vehicle body position Pg of the upper swing body 2 supporting the working implement 1, a blade tip position data acquiring unit 52 which acquires blade tip position data indicating the relative position of the blade tip 10 of the bucket 11 with respect to the reference position Ps of the upper swing body 2 in the local coordinate system, a target excavating topography data generating unit 53 which generates target excavating topography data indicating the target shape of the excavation target, a distance acquiring unit 54 which acquires distance data indicating the distance between the target excavating topography and the blade tip position of the bucket 11, a target blade tip speed determining unit 55 which determines the target blade tip speed of the bucket 11 based on the distance data, an operation amount acquiring unit 56 which acquires the operation amount for operating the working implement 1, a target boom speed calculating unit 57 which calculates a target boom speed based on the target blade tip speed and at least one of the arm operation amount and the bucket operation amount acquired by the operation amount acquiring unit 56, a correction amount calculating unit 58 which calculates a correction amount of the target boom speed based on the integration in time of the distance between the blade tip position and the target excavating topography, a correction amount limiting unit 59 which limits the correction amount based on the distance between the blade tip position and the target excavating topography, a working implement control unit 60 which controls the boom cylinder 23 driving the boom 13 based on the target boom speed corrected by the correction amount, a storage unit 61 which stores the specification data of the excavator 100, and an input/output unit 62.

The processor of the control device 50 includes the vehicle body position data acquiring unit 51, the blade tip position data acquiring unit 52, the target excavating topography data generating unit 53, the distance acquiring unit 54, the target blade tip speed determining unit 55, the operation amount acquiring unit 56, the target boom speed calculating unit 57, the correction amount calculating unit 58, the correction amount limiting unit 59, and the working implement control unit 60. The storage device of the control device 50 includes the storage unit 61. The input/output interface device of the control device 50 includes the input/output unit 62.

The vehicle body position data acquiring unit 51 acquires the vehicle body position data indicating the vehicle body position Pg from the position detector 30 through the input/output unit 62. The vehicle body position Pg is a current absolute position defined by the global coordinate system. The vehicle body position detector 31 detects the vehicle body position Pg based on at least one of the installation position Pla and the installation position Plb of the GPS antenna 31. The vehicle body position data acquiring unit 51 acquires the vehicle body position data indicating the vehicle body position Pg from the vehicle body position detector 31.

The blade tip position data acquiring unit 52 acquires the blade tip position data indicating the blade tip position from the blade tip position detector 34 through the input/output unit 56. The blade tip position is a current relative position defined by the local coordinate system. The blade tip position data acquiring unit 52 acquires the blade tip position data indicating the blade tip position as the relative position of the blade tip 10 with respect to the reference position Ps of the upper swing body 2 from the blade tip position detector 34. In addition, the blade tip position detector 34 can calculate the current absolute position Pb of the blade tip 10 based on the vehicle body position Pg of the upper swing body 2, the relative position between the reference position Ps of the upper swing body 2 and the blade tip 10, and the specification data of the excavator 100. The blade tip position data acquired by the blade tip position data acquiring unit 52 from the blade tip position detector 32 may include the current absolute position Pb of the blade tip 10.

The target excavating topography data generating unit 53 generates the target excavating topography data indicating the target shape of the excavation target corresponding to the blade tip position by using the target construction data and the blade tip position data supplied from the target construction data generating device 70. The target excavating topography data generating unit 53 generates the target excavating topography data in the local coordinate system.

Figure 8:
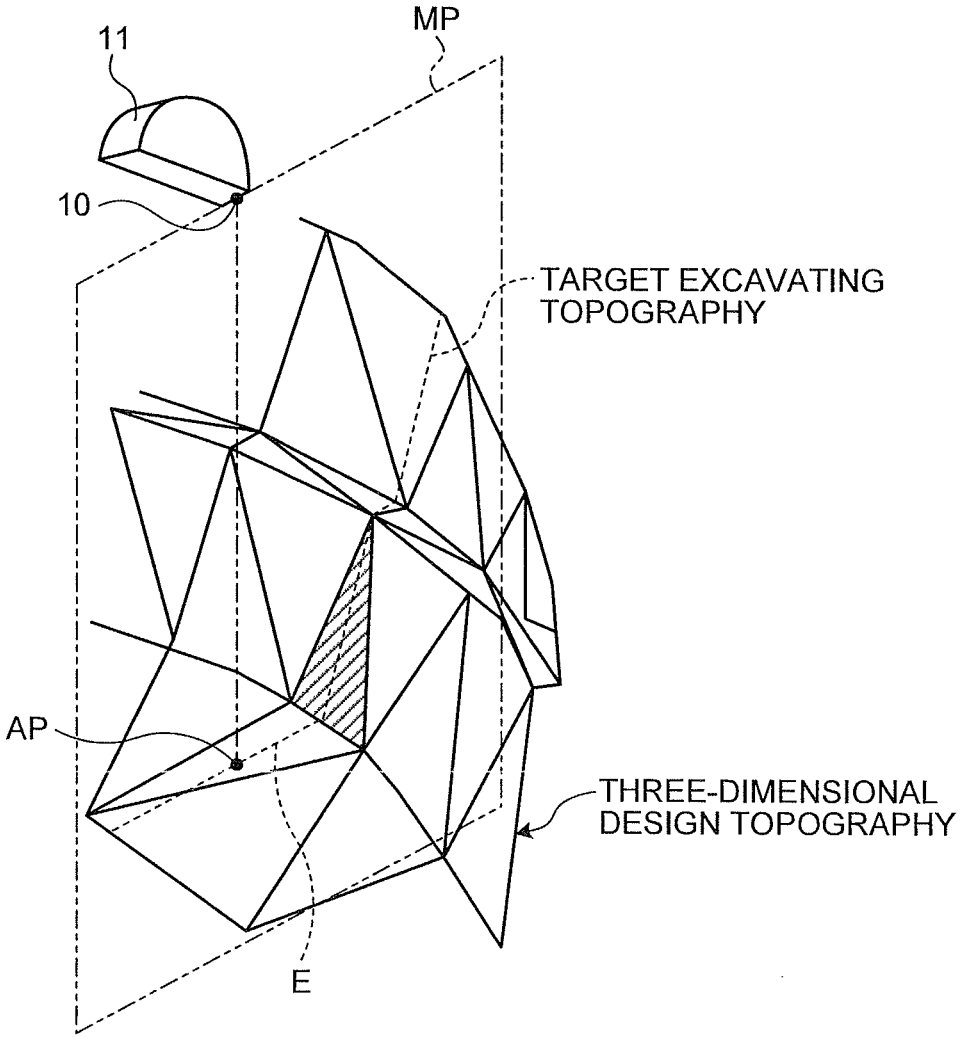
FIG. 8 is a schematic view illustrating a process of a target excavating topography data generating unit according to the embodiment.

FIG. 8 is a diagram illustrating a relation between the target excavating topography data and the target construction data indicating the three-dimensional design topography. As illustrated in FIG. 8, the target excavating topography data generating unit 53 acquires the intersection line E between the three-dimensional design topography and the work machine operation plane MP of the working implement 1 defined in the front to back direction of the upper swing body 2 as the candidate line of the target excavating topography based on the target construction data and the blade tip position data. The target excavating topography data generating unit 53 sets the direct lower point of the blade tip 10 in the candidate line of the target excavating topography as the reference point AP of the target excavating topography. The control device 50 determines a single inflection point and a plurality of inflection points before and after the reference point AP of the target excavating topography and the front and rear lines thereof as the target excavating topography as the excavation target. The target excavating topography data generating unit 53 generates the target excavating topography data indicating the design topography as the target shape of the excavation target.

In FIG. 7, the distance acquiring unit 54 calculates the distance d between the blade tip position Pb and the target excavating topography based on the blade tip position acquired by the blade tip position data acquiring unit 52 and the target excavating topography generated by the target excavating topography data generating unit 53.

In addition, in the embodiment, the blade tip position Pb is used as the control target. However, the distance between the arbitrary point of the bucket 11 including the outer periphery of the bucket 11 and the target excavating topography may be set as the distance d between the bucket 11 and the target excavating topography by the use of the outer shape dimension of the bucket 11.

The target blade tip speed determining unit 55 determines the target blade tip speed of the bucket 11 based on the distance d between the blade tip position Pb and the target excavating topography.

Figure 9:
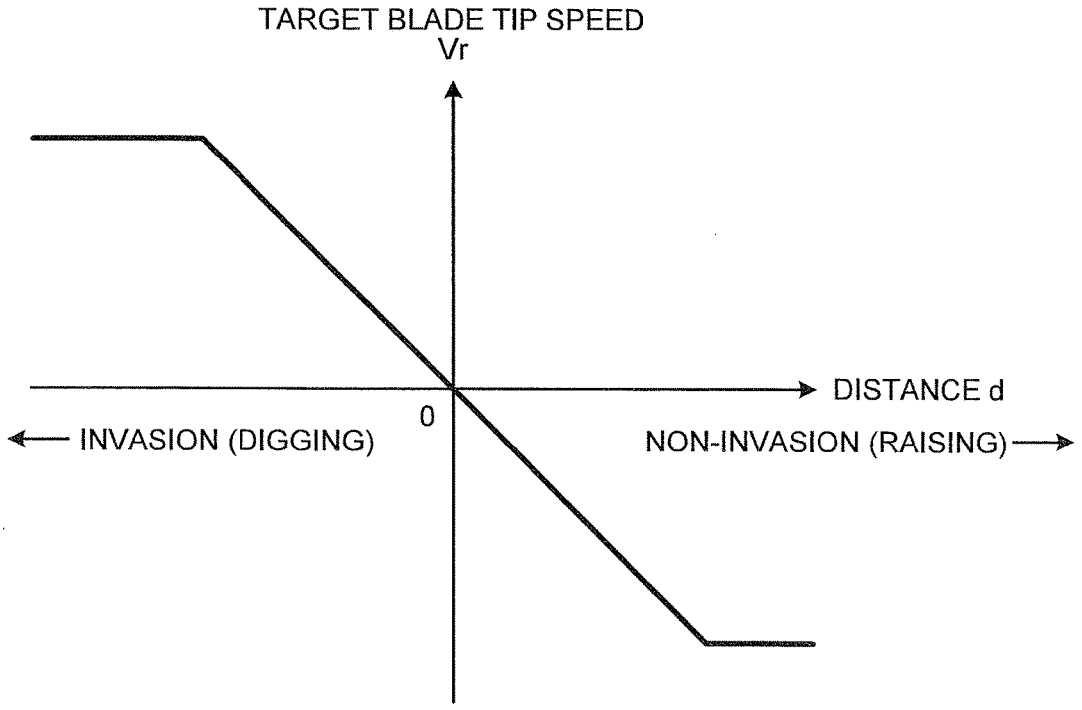
FIG. 9 is a diagram illustrating a relation between a distance and a target blade tip speed according to the embodiment.

FIG. 9 is a diagram illustrating an example of a relation between the distance d and the target blade tip speed. In the graph illustrated in FIG. 9, the horizontal axis indicates the distance d, and the vertical axis indicates the target blade tip speed. In FIG. 9, the distance d has a positive value when the surface of the target excavating topography is not invaded by the blade tip 10. The distance d has a negative value when the surface of the target excavating topography is invaded by the blade tip 10. The non-invasion state in which the surface of the target excavating topography is not invaded by the blade tip 10 indicates a state where the blade tip 10 exists outside (above) the surface of the target excavating topography. In other words, the blade tip exists at a position not exceeding the target excavating topography. The invasion state in which the surface of the target excavating topography is invaded by the blade tip 10 indicates a state where the blade tip 10 exists inside (below) the surface of the target excavating topography. In other words, the blade tip exists at a position exceeding the target excavating topography. In the non-invasion state, the blade tip 10 is raised from the target excavating topography. In the invasion state, the target excavating topography is dug by the blade tip 10. The distance d is zero when the blade tip 10 matches the surface of the target excavating topography.

In the embodiment, the speed at which the blade tip 10 is directed from the inside of the target excavating topography toward the outside thereof is set to a positive value, and the speed at which the blade tip 10 is directed from the outside of the target excavating topography toward the inside thereof is set to a negative value. That is, the speed at which the blade tip 10 is directed toward the upside of the target excavating topography is set to a positive value, and the speed at which the blade tip 10 is directed toward the downside of the target excavating topography is set to a negative value.

As illustrated in FIG. 9, the target blade tip speed determining unit 55 determines whether the target blade tip speed is positive or negative so that the blade tip 10 matches the target excavating topography. Further, the target blade tip speed determining unit 55 determines the target blade tip speed so that the absolute value of the target blade tip speed increases as the distance d increases and the absolute value of the target blade tip speed decreases as the distance d decreases.

In FIG. 7, the operation amount acquiring unit 56 acquires the operation amount of the operation device 40. The operation amount of the operation device 40 is correlated with the pilot hydraulic pressure of the oil passages 44A and 44B. The pilot hydraulic pressure of the oil passages 44A and 44B is detected by the pressure sensors 46A and 46B. The correlation data indicating the correlation between the operation amount of the operation device 40 and the pilot hydraulic pressure of the oil passages 44A and 44B is obtained in advance by a preliminary test or a simulation and is stored in the storage unit 61. The operation amount acquiring unit 56 acquires the operation amount data indicating the operation amount of the operation device 40 from the detection signals (PPC pressure) from the pressure sensors 46A and 46B based on the detection signals of the pressure sensors 46A and 46B and the correlation data stored in the storage unit 61. The operation amount acquiring unit 56 acquires the bucket operation amount of the operation device 40 for operating the bucket 11, the arm operation amount of the operation device 40 for operating the arm 12, and the boom operation amount of the operation device 40 for operating the boom 13.

The target boom speed calculating unit 57 calculates the target boom speed based on the target blade tip speed determined by the target blade tip speed determining unit 55 and at least one of the arm operation amount and the bucket operation amount acquired by the operation amount acquiring unit 56. In the leveling assist control, the movement of the bucket 11 and the movement of the arm 12 are set based on the operation of the operation device 40 by the operator. In the leveling assist control, the movement of the boom 10 is controlled by the control device 50 so that the blade tip 10 of the bucket 11 moves along the target excavating topography while the bucket 11 and the arm 12 are operated through the operation device 40. The target boom speed calculating unit 55 calculates the blade tip speed when the bucket 11 is operated from the bucket operation amount for operating the bucket 11 by the operation device 40 and calculates the target boom speed counteracting the blade tip speed based on the movement of the bucket 11 so as to offset a deviation between the blade tip 10 and the target excavating topography during the operation of the bucket 11. Similarly, the target boom speed calculating unit 55 calculates the blade tip speed when the arm 12 is operated from the arm operation amount for operating the arm 12 by the operation device 40 and calculates the target boom speed counteracting the blade tip speed based on the movement of the arm 12 so as to offset a deviation between the blade tip 10 and the target excavating topography during the operation of the arm 12. Since the target boom speed is calculated based on the target blade tip speed and at least one of the arm operation amount and the bucket operation amount of the operation device 40 and the movement of the boom 13 is controlled at the target boom speed, the blade tip 10 and the target excavating topography can be close to each other.

The correction amount calculating unit 58 calculates the correction amount of the target boom speed based on the integration in time of the distance d between the blade tip position Pb and the target excavating topography. The correction amount calculating unit 58 calculates the correction amount based on the integration in time of the distance d from a predetermined past time point to a current time point and compensates the target boom speed by integration.

The correction amount is calculated based on the integration in time of the distance d when the blade tip 10 is separated from the target excavating topography. Since the target boom speed is compensated by integration based on the distance d when the target excavating topography is dug by the blade tip 10, the boom 13 can be driven so that the distance d becomes zero from the state where the target design topography is dug.

The correction amount limiting unit 59 limits the correction amount calculated by the correction amount calculating unit 58 so that the speed is not overcompensated based on the distance d between the blade tip position Pb and the target excavating topography. The correction amount limiting unit 59 calculates the upper limit of the correction amount based on the distance d. In the embodiment, the correction amount limiting unit 59 calculates the upper limit of the correction amount based on the target blade tip speed determined from the distance d.

The working implement control unit 60 controls the boom cylinder 23 so that the boom 13 is driven based on the target boom speed corrected by the correction amount. The working implement control unit 60 compares the correction amount calculated by the correction amount calculating unit 58 with the upper limit calculated by the correction amount limiting unit 59 and determines the instruction signal output to the control valve 45C based on the upper limit when the correction amount calculated by the correction amount calculating unit 58 is larger than the upper limit calculated by the correction amount limiting unit 59. The working implement control unit 60 controls the boom cylinder 23 by outputting the instruction signal to the control valve 45C and controls the boom cylinder 23 based on the correction amount when the correction amount is equal to or smaller than the upper limit.

[Excavator Control Method]

Figure 10:
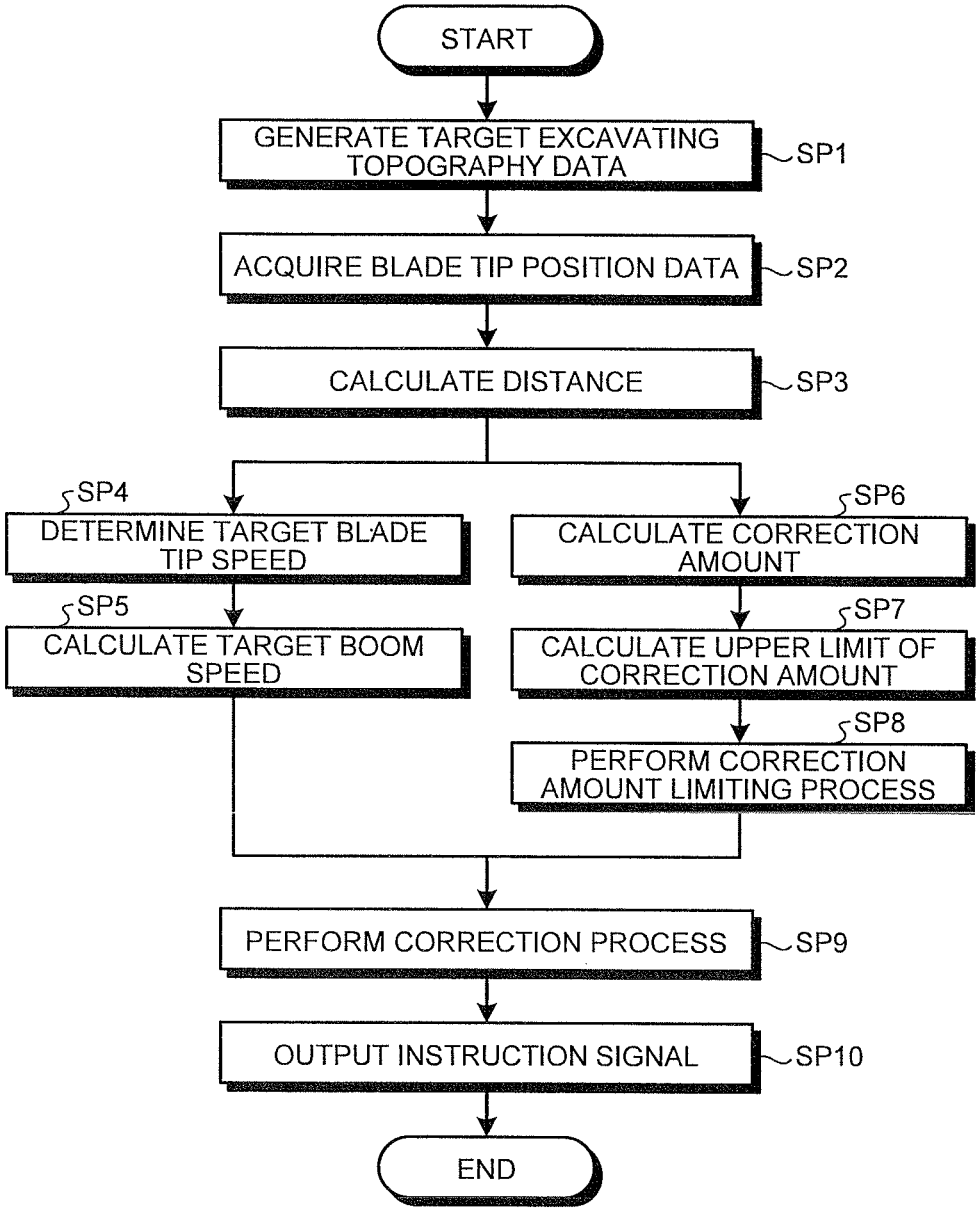
FIG. 10 is a flowchart illustrating an example of an excavator control method according to the embodiment.
Figure 11:
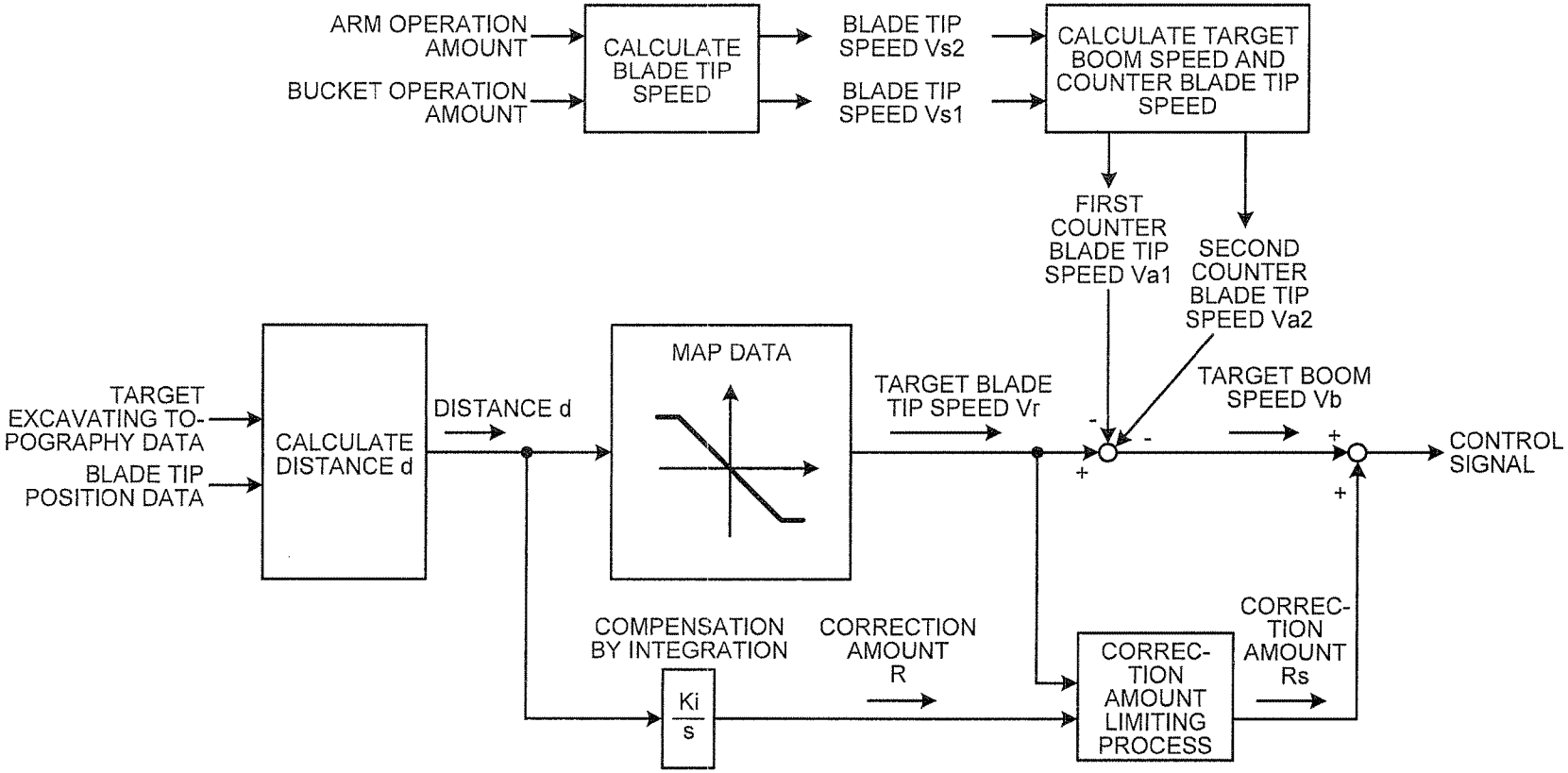
FIG. 11 is a control block diagram illustrating an example of the control system according to the embodiment.

Next, a method of controlling the excavator 100 according to the embodiment will be described with reference to FIGS. 10 and 11. FIG. 10 is a flowchart illustrating a method of controlling the excavator 100 according to the embodiment. FIG. 11 is a control block diagram of the excavator 100 according to the embodiment.

The target construction data is supplied from the target construction data generating device 70 to the control device 50. The target excavating topography data generating unit 53 generates the target excavating topography data by using the target construction data supplied from the target construction data generating device 70 (step SP1).

The blade tip position data is supplied from the blade tip position detector 34 to the control device 50. The blade tip position data acquiring unit 52 acquires the blade tip position data from the blade tip position detector 34 (step SP2).

The distance acquiring unit 54 calculates the distance d between the blade tip position and the target excavating topography based on the target excavating topography generated by the target excavating topography data generating unit 53 and the blade tip position data acquired by the blade tip position data acquiring unit 52 (step SP3). Accordingly, the distance data between the blade tip position of the bucket 11 and the target excavating topography is acquired.

The target blade tip speed determining unit 55 determines the target blade tip speed Vr of the bucket 11 based on the distance data (step SP4). As described above by referring to FIG. 9, map data indicating a relation between the distance d and the target blade tip speed Vr is stored in the storage unit 61. The target blade tip speed determining unit 55 determines the target blade tip speed Vr in response to the distance d based on the distance data acquired by the distance acquiring unit 54 and the map data stored in the storage unit 61.

The target boom speed calculating unit 57 calculates the target boom speed Vb for the leveling assist control based on the target blade tip speed Vr determined by the target blade tip speed determining unit 55 and at least one of the arm operation amount and the bucket operation amount acquired by the operation amount acquiring unit 56 (step SP5).

As illustrated in FIG. 11, the determined target blade tip speed Vr is added to the counter blade tip speed Va counteracting the blade tip speed Vs set in response to the arm operation amount and the bucket operation amount of the operation device 40. Specifically, the target blade tip speed Vr is added to the first counter blade tip speed Va1 counteracting the blade tip speed Vs1 set in response to the bucket operation amount of the operation device 40 and the second counter blade tip speed Va2 counteracting the blade tip speed Vs2 set in response to the arm operation amount of the operation device 40. The first counter blade tip speed Va1 and the second counter blade tip speed Va2 have negative values. From the added value of the target blade tip speed Vr, the first counter blade tip speed Va1, and the second counter blade tip speed Va2, the target boom speed Vb is calculated.

The target boom speed calculating unit 57 calculates the blade tip speed Vs1 when the bucket 11 is operated by the bucket operation amount from the bucket operation amount for operating the bucket 11 by the operation device 40. As described above, when the hydraulic oil supply amount per unit time supplied from the main hydraulic pump 42 to the bucket cylinder 21 through the direction control valve 41 is adjusted, the bucket cylinder speed is adjusted. The bucket cylinder speed is correlated with the movement amount of the spool of the direction control valve 41. The movement amount of the spool of the direction control valve 41 is correlated with the pilot hydraulic pressure of the oil passages 44A and 44B. The pilot hydraulic pressure of the oil passages 44A and 44B is correlated with the bucket operation amount by the operation device 40. Further, the pilot hydraulic pressure of the oil passages 44A and 44B is detected by the pressure sensors 46A and 46B. The correlation data indicating such a correlation is obtained in advance by a preliminary test or a simulation and is stored in the storage unit 61. Thus, the target boom speed calculating unit 57 can calculate the bucket cylinder speed from the detection signals (PPC pressure) of the pressure sensors 46A and 46B based on the detection signals of the pressure sensors 46A and 46B of the bucket cylinder 21 and the correlation data stored in the storage unit 61, and calculate the blade tip speed Vs1 of the bucket 11 when the bucket cylinder 21 is driven at the bucket cylinder speed based on the bucket cylinder speed. Similarly, the target boom speed calculating unit 57 can calculate the arm cylinder speed based on the detection signals of the pressure sensors 46A and 46B of the arm cylinder 22 and the correlation data stored in the storage unit 61, and calculate the blade tip speed Vs2 of the bucket 11 when the arm cylinder 22 is driven at the arm cylinder speed based on the arm cylinder speed.

The target boom speed calculating unit 57 calculates the first counter blade tip speed Va1 counteracting the blade tip speed Vs1 of the bucket 11 when the bucket cylinder 21 is driven at a predetermined bucket cylinder speed and the second counter blade tip speed Va2 counteracting the blade tip speed Vs2 of the bucket 11 when the arm cylinder 22 is driven at a predetermined arm cylinder speed. The first counter blade tip speed Va1 is a value used to offset the blade tip speed Vs1 of the bucket 11 generated by the driving of the bucket cylinder 21 by the blade tip speed Vs3 of the bucket 11 generated by the driving of the boom cylinder 23. The second counter blade tip speed Va2 is a value used to offset the blade tip speed Vs2 of the bucket 11 generated by the driving of the arm cylinder 22 by the blade tip speed Vs3 of the bucket 11 generated by the driving of the boom cylinder 23. The target boom speed calculating unit 55 calculates the target boom speed Vb for the leveling assist control based on the target blade tip speed Vr, the first counter blade tip speed Va1, and the second counter blade tip speed Va2.

The correction amount calculating unit 58 calculates the correction amount R of the target boom speed Vb based on the integration in time of the distance d (step SP6).

The correction amount calculating unit 58 calculates the correction amount R based on the integration in time of the distance d from the time point (the past time point) at which the leveling assist control is started to the current time point and compensates the target boom speed Vb by integration.

The time point at which the leveling assist control is started is a time point at which an instruction for selecting a control mode so that the operator starts the excavating operation is transmitted to the control device 50 through a mode selecting unit (not illustrated) and the control signal starts to be output from the control device 50 to the control valve 45C. In the leveling assist control, the boom 13 is raised so that the blade tip 10 is disposed at the same position as the target excavating topography from the state where the blade tip 10 digs the target excavating topography. The correction amount calculating unit 58 calculates the correction amount R based on the integration in time of the distance d from the past time point at which the leveling assist control is started to the current time point at which the blade tip 10 is disposed on the target excavating topography.

The correction amount limiting unit 59 calculates the upper limit A of the correction amount R based on the distance d at the current time point (step SP7). In the embodiment, the correction amount limiting unit 59 calculates the upper limit A of the correction amount R based on the target blade tip speed Vr determined from the distance d at the current time point.

In the embodiment, the upper limit A is determined based on Equation (1) below.

$$A=a\times Vr+S \quad (1)$$

In Equation (1), A indicates the upper limit of the correction amount R, Vr indicates the target blade tip speed, a indicates the coefficient, and S indicates the offset amount. The offset amount S is determined arbitrarily. As indicated in Equation (1), the upper limit A and the target blade tip speed Vr are proportional to each other. As the target blade tip speed Vr decreases, the upper limit A decreases. Further, the upper limit A of the correction amount R is changed when the offset amount S is changed. As the offset amount S decreases, the upper limit A decreases, and hence the limitation for the correction amount R becomes strict. As the offset amount S increases, the upper limit A increases, and hence the limitation for the correction amount R becomes moderate.

The correction amount limiting unit 59 performs a correction limiting process of limiting the correction amount R calculated by the correction amount calculating unit 58 using the calculated upper limit A (step SP8).

The correction amount limiting unit 59 compares the correction amount R calculated by the correction amount calculating unit 58 with the upper limit A calculated by the correction amount limiting unit 59, outputs the upper limit A calculated by the correction amount limiting unit 59 as the correction amount Rs for correcting the target boom speed Vb to the working implement control unit 60 when the correction amount R calculated by the correction amount calculating unit 58 is larger than the upper limit A calculated by the correction amount limiting unit 59, and outputs the correction amount R calculated by the correction amount calculating unit 58 as the correction amount Rs for correcting the target boom speed Vb to the working implement control unit 60 when the correction amount R calculated by the correction amount calculating unit 58 is equal to or smaller than the upper limit A calculated by the correction amount limiting unit 59.

The working implement control unit 60 performs a correction process of correcting (compensating by integration) the target boom speed Vr calculated in step SP5 by using the correction amount Rs used in the correction amount limiting process of step SP8 (step SP9).

The working implement control unit 60 outputs the instruction signal for performing the leveling assist control on the boom cylinder 23 to the control valve 45C based on the corrected target boom speed Vb (step SP10). The working implement control unit 60 outputs the instruction signal for controlling the boom cylinder 23 based on the upper limit A calculated by the correction amount limiting unit 59 when the correction amount R calculated by the correction amount calculating unit 58 is larger than the upper limit A calculated by the correction amount limiting unit 59. The working implement control unit 60 outputs the instruction signal for controlling the boom cylinder 23 based on the correction amount R calculated by the correction amount calculating unit 58 when the correction amount R calculated by the correction amount calculating unit 58 is equal to or smaller than the upper limit A calculated by the correction amount limiting unit 59.

COMPARATIVE EXAMPLE

A comparative example will be described. In the control device according to the comparative example, the correction amount limiting process is not performed. In the comparative example, the correction amount R is directly output and is added to the target boom speed Vb.

Figure 12:
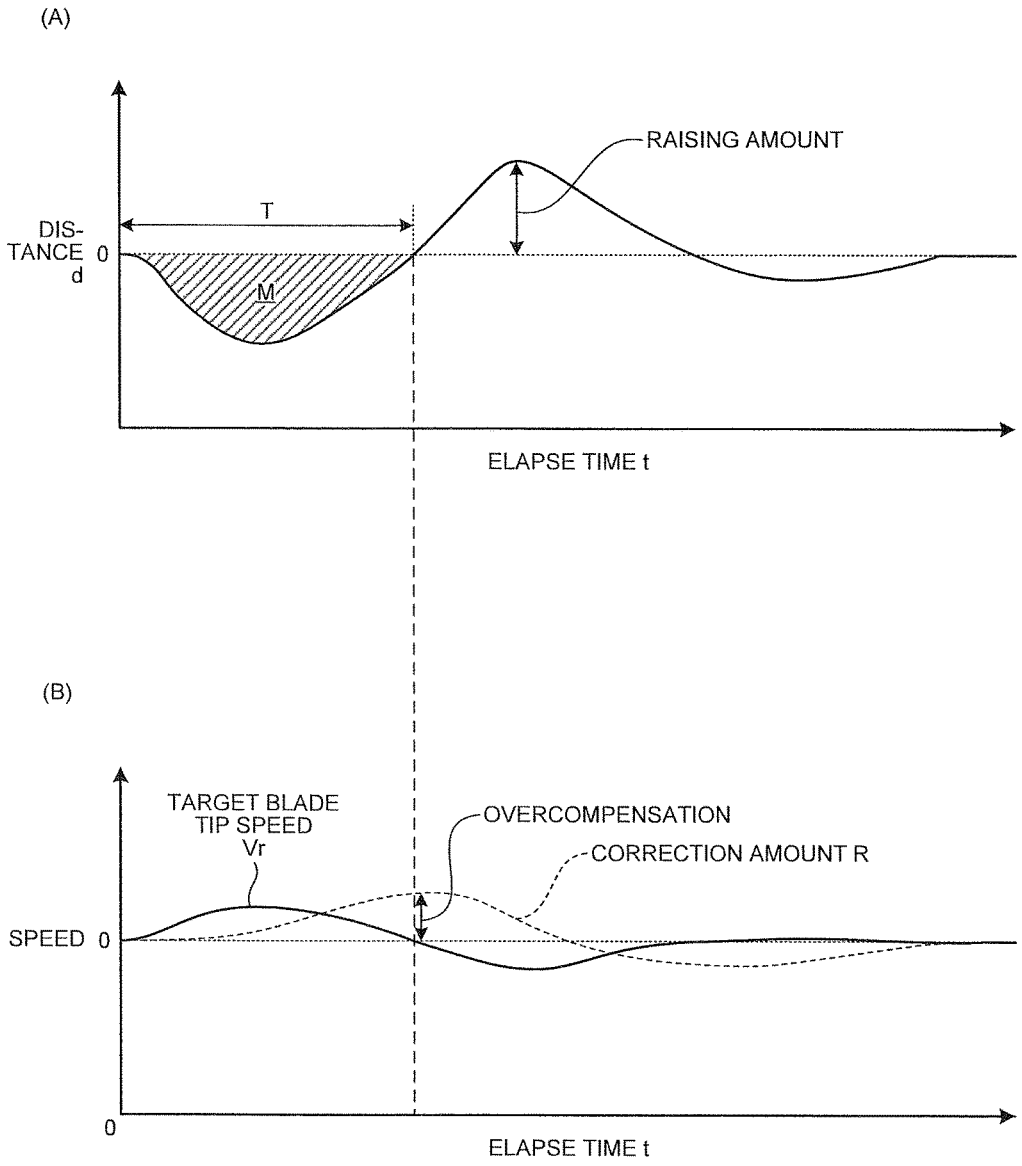
FIG. 12 is a diagram illustrating a state where a distance and a correction amount change in a comparative example.

FIG. 12 is a graph illustrating an operation when the excavator 100 is controlled by the control method according to the comparative example. FIG. 12(A) illustrates a relation between the distance d and the elapse time t from the time point at which the leveling assist control is started. In FIG. 12(A), the horizontal axis indicates the elapse time t, and the vertical axis indicates the distance d. FIG. 12(B) illustrates a relation of the target blade tip speed Vr and the correction amount R with respect to the elapse time t from the time point at which the leveling assist control is started. In FIG. 12(B), the horizontal axis indicates the elapse time t, and the vertical axis indicates the speed.

In FIG. 12(A), the blade tip position Pb matches the target excavating topography when the distance d is "0". When the distance d has a positive value, the blade tip 10 is raised from the target excavating topography. When the distance d has a negative value, the blade tip 10 digs the target excavating topography. In the leveling assist control, the boom 13 is raised while the boom cylinder 23 is controlled so that the blade tip 10 of the bucket 11 returns to the target excavating topography from the state where the target excavating topography is dug by the blade tip 10 of the bucket 11.

In the control system according to the comparative example, the target blade tip speed Vr of the bucket 11 is determined from the distance d between the current blade tip position of the bucket 11 and the target excavating topography, and the determined target blade tip speed Vr and the counter blade tip speed Va (the first counter blade tip speed Va1 and the second counter blade tip speed Va2) counteracting the blade tip speed of the bucket 11 in response to the arm operation amount and the bucket operation amount by the operator are subtracted, so that the target boom speed Vr is calculated. The correction amount R is calculated based on the integration in time of the distance d (corresponding to a portion indicated by the diagonal line M in FIG. 12(A)) from the time point at which the leveling assist control is started and the blade tip 10 digs the target excavating topography to the time point at which the blade tip returns to the target excavating topography. The target boom speed Vr is corrected (compensated by integration) by using the calculated correction amount R, and the control signal for controlling the boom cylinder 23 based on the target boom speed Vr compensated by integration is output.

As illustrated in FIG. 12(A), even in the leveling assist control using the compensation by integration according to the comparative example, the boom cylinder 23 is controlled so that the boom 13 is raised when the blade tip 10 of the bucket 11 digs the target excavating topography.

In the excavator 100, a time delay exists in the responsiveness of the boom cylinder 23 with respect to the instruction signal for controlling the boom cylinder 23 due to an increase in the weight of the working implement 1, a delay in the responsiveness of hydraulic pressure, or hysteresis generated when driving a hydraulic driving unit. For that reason, in a case where the boom 13 is raised by the leveling assist control so that the blade tip 10 of the bucket 11 returns to the target excavating topography from the state where the blade tip digs the target excavating topography, when the time T (see FIG. 12(A)) in which the blade tip 10 of the bucket 11 digs the target excavating topography is long, the correction amount R increases excessively (so as to be overcompensated) when the blade tip 10 of the bucket 11 returns to the target excavating topography as illustrated in FIG. 12(B), and hence the boom 13 is raised continuously even when the blade tip 10 is raised. As a result, as illustrated in FIG. 12(A), a phenomenon occurs in which the blade tip 10 of the bucket 11 is excessively separated (raised) from the target excavating topography. Consequently, a portion which is not excavated by the working implement 1 is generated, and hence the leveling operation is performed in a state different from the target excavating topography.

[Operation and Effect]

Figure 13:
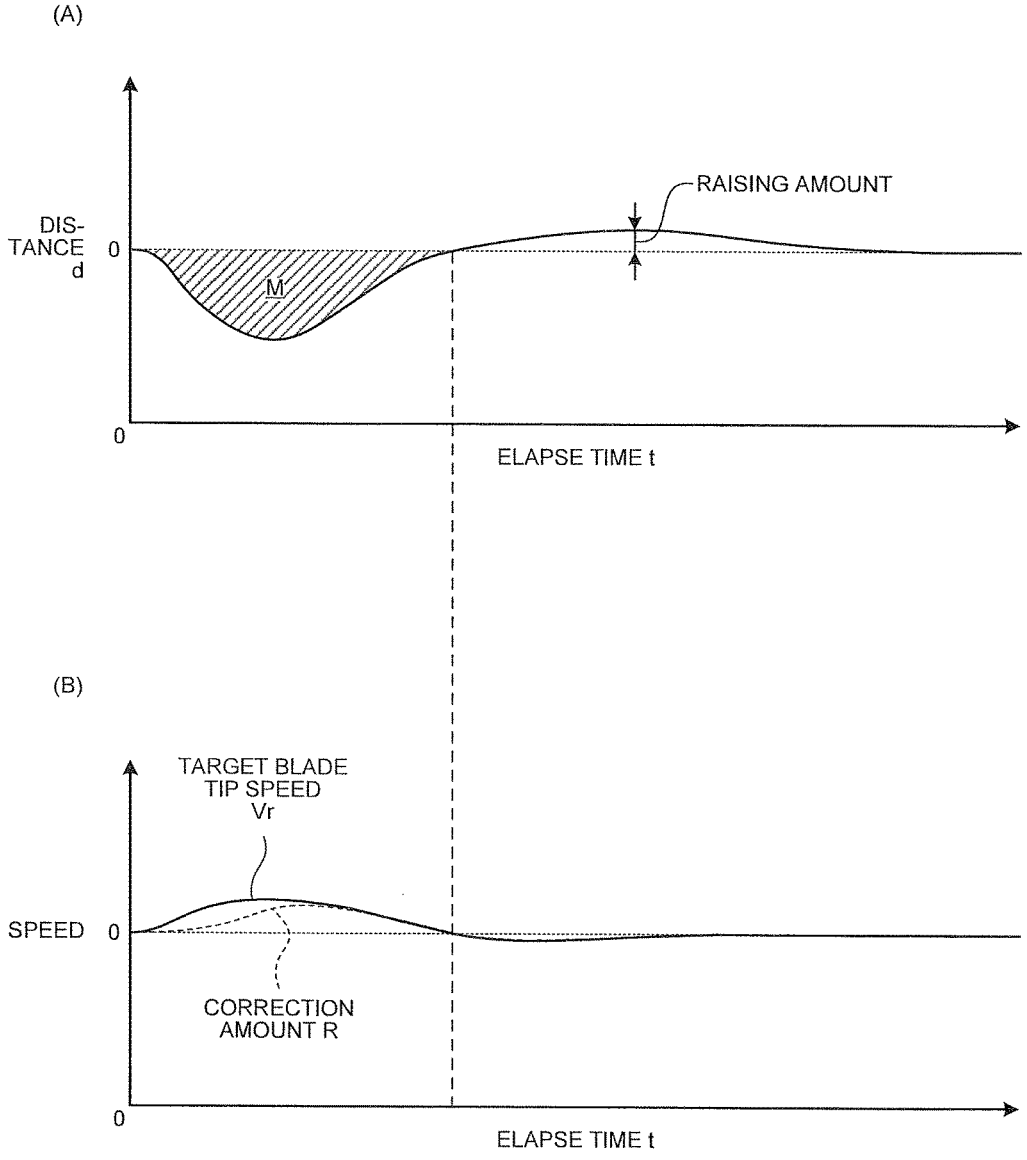
FIG. 13 is a diagram illustrating a state where a distance and a correction amount change according to the embodiment.

FIG. 13 is a graph illustrating an operation when the excavator 100 is controlled by the control method according to the embodiment. FIG. 13(A) illustrates a relation between the distance d and the elapse time t from the time point at which the leveling assist control is started. In FIG. 13(A), the horizontal axis indicates the elapse time t, and the vertical axis indicates the distance d. FIG. 13(B) illustrates a relation of the target blade tip speed Vr and the correction amount Rs with respect to the elapse time t from the time point at which the leveling assist control is started. In FIG. 13(B), the horizontal axis indicates the elapse time t, and the vertical axis indicates the speed.

In the leveling assist control, the working implement control unit 60 raises the boom 13 by controlling the boom cylinder 23 so that the blade tip 10 of the bucket 11 returns to the target excavating topography from the state where the blade tip 10 of the bucket 11 digs the target excavating topography.

The correction amount calculating unit 58 calculates the correction amount R based on the integration in time of the distance d (corresponding to a portion indicated by the diagonal line M in FIG. 13(A)) from the time point at which the leveling assist control is started and the blade tip 10 digs the target excavating topography to the time point at which the blade tip 10 returns to the target excavating topography by the raising operation of the boom 13. The correction amount limiting unit 59 limits the correction amount R in the raising operation of the boom 13.

Since the correction amount R is limited in the raising operation of the boom 13, an increase in correction amount R is suppressed as illustrated in FIG. 13(B) even when a state in which the blade tip 10 of the bucket 11 digs the target topography changes to a state where the blade tip is disposed at the same position as the target excavating topography, and hence the overcompensation of the correction amount R is prevented. Since the target boom speed Vb is corrected by the correction amount Rs preventing the overcompensation thereof, it is possible to suppress the blade tip 10 of the bucket 11 from being excessively raised from the target excavating topography as illustrated in FIG. 13(A), and hence to decrease the raising amount.

In this way, according to the embodiment, since the correction amount R is limited, it is possible to suppress degradation in excavating precision by preventing the blade tip 10 from being raised until the blade tip 10 of the bucket 11 returns to the target excavating topography from the state where the blade tip digs the target excavating topography in the leveling assist control.

Further, in the embodiment, as indicated by Equation (1), the upper limit A of the correction amount R is calculated, the correction amount limiting process of the correction amount R is performed so as not to exceed the upper limit A, and hence the correction amount Rs is calculated. Thus, it is possible to smoothly perform a strict or moderate limitation for the correction amount R just by changing the upper limit A.

Further, as indicated by Equation (1), the upper limit A and the target blade tip speed Vr are proportional to each other. Further, as described above by referring to FIG. 9, the target blade tip speed Vr is proportional to the distance d. Thus, the upper limit A is proportional to the distance d. In the embodiment, the correction amount limiting unit 59 decreases the upper limit A of the correction amount R as the distance d (the target blade tip speed Vr) at the current time point decreases. Accordingly, since the overcompensation is suppressed, the correction amount R can be also zero when the distance d (the target blade tip speed Vr) at the current time point is zero.

Further, as indicated by Equation (1), it is possible to smoothly perform a strict or moderate limitation for the correction amount R just by changing the offset amount S for the upper limit A.

[Other Embodiments]

The correction amount limiting unit 59 can change the upper limit A of the correction amount R based on the arm operation amount or the arm speed (the arm cylinder speed). For example, the correction amount limiting unit 59 increases the upper limit A as the arm operation amount or the arm speed decreases (for a moderate limitation) and decreases the upper limit A as the arm operation amount or the arm speed increases (for a strict limitation). When the arm 12 moves at a low speed, the raising of the blade tip 10 in the leveling assist control is suppressed even when the correction amount R is not limited. When the arm 12 moves at a high speed, the raising of the blade tip 10 in the leveling assist control can be suppressed while the correction amount R is limited.

The correction amount limiting unit 59 can change the upper limit A by changing the offset amount S indicated by Equation (1) based on the arm operation amount or the arm speed (the arm cylinder speed).

As described above, the arm cylinder speed is correlated with the pilot hydraulic pressure of the oil passages 44A and 44B. The pilot hydraulic pressure of the oil passages 44A and 44B is detected by the pressure sensors 46A and 46B. The correlation data is stored in the storage unit 61. The detection signals of the pressure sensors 46A and 46B are output to the control device 50. The correction amount limiting unit 59 can acquire the arm operation amount or the arm speed (the arm cylinder speed) based on the detection signals of the pressure sensors 46A and 46B. The correction amount limiting unit 59 can change the offset amount S based on the detection values of the pressure sensors 46A and 46B.

Figure 14:
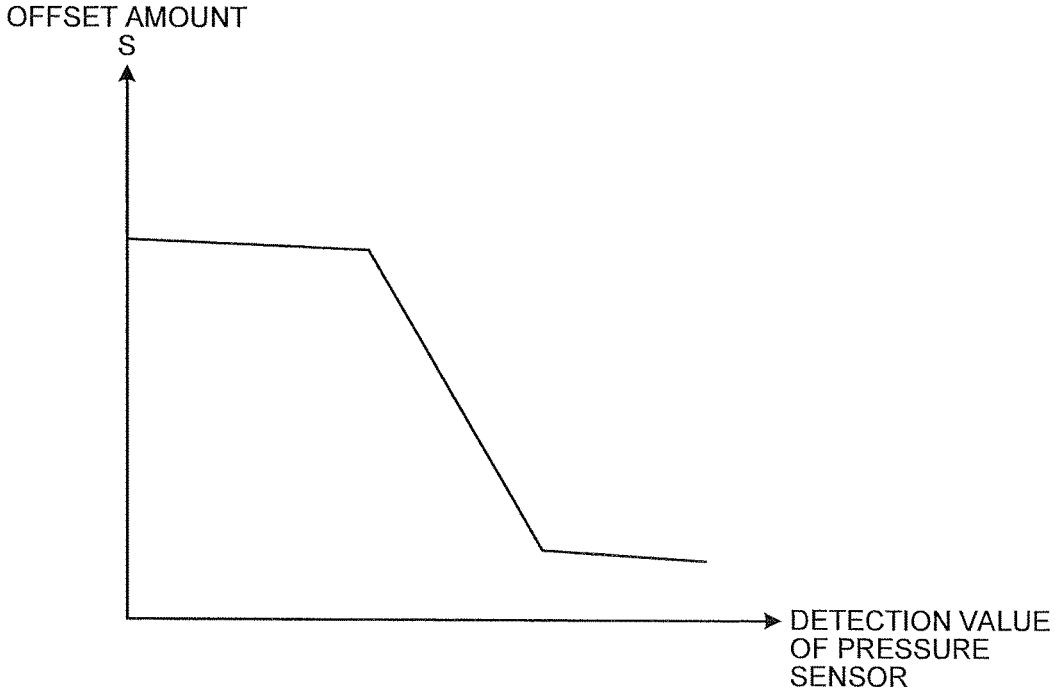
FIG. 14 is a diagram illustrating a relation between an offset amount and a detection value of a pressure sensor according to the embodiment.

FIG. 14 is a diagram illustrating a relation between each of the detection values of the pressure sensors 46A and 46B and the offset amount S. As illustrated in FIG. 14, a large offset amount S is set as the detection values of the pressure sensors 46A and 46B decrease (the arm cylinder speed decreases), and the limitation becomes moderate. A small offset amount S is set as the detection values of the pressure sensors 46A and 46B increase (the arm cylinder speed increases), and the limitation becomes strict. The map data illustrated in FIG. 14 is stored in the storage unit 61. The correction amount limiting unit 59 determines the offset amount S in response to the arm cylinder speed based on the detection values of the pressure sensors 46A and 46B and the map data of the storage unit 61.

In addition, the correction amount limiting unit 59 may change the upper limit A of the correction amount R based on the weight of the bucket 11 when the bucket 11 connected to the arm 12 can be replaced. For example, the correction amount limiting unit 59 increases the upper limit A as the weight of the bucket 11 decreases (for a moderate limitation) and decreases the upper limit A as the weight of the bucket 11 increases (for a strict limitation). When the weight of the bucket 11 is small, the raising of the blade tip 10 in the leveling assist control is suppressed even when the correction amount R is not limited. When the weight of the bucket 11 is large, the raising of the blade tip 10 in the leveling assist control can be suppressed while the correction amount R is limited.

Figure 15:
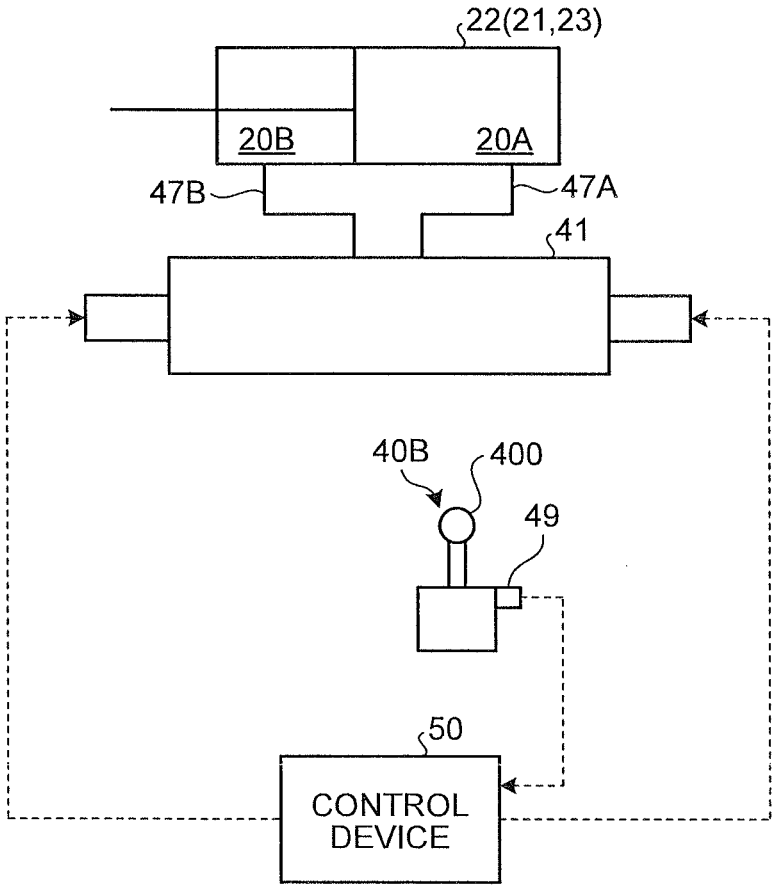
FIG. 15 is a diagram illustrating an example of an operation device according to the embodiment.

In addition, in the above-described embodiment, the operation device 40 is set as the pilot hydraulic operation device. The operation device 40 may be of an electric type. FIG. 15 is a diagram illustrating an example of an electric operation device 40B. As illustrated in FIG. 15, the operation device 40B includes an operation member 400 that corresponds to an electric lever and an operation amount sensor 49 that electrically detects the operation amount of the operation member 400. The operation amount sensor 49 includes a potentiometer and an angle meter and detects the inclination angle of the inclined operation member 400. The detection signal of the operation amount sensor 49 is output to the control device 50. The operation amount acquiring unit 56 of the control device 50 acquires the detection signal of the operation amount sensor 49 as the operation amount. The control device 50 outputs an instruction signal (electric signal) for driving the direction control valve 41 based on the detection signal of the operation amount sensor 49. The direction control valve 41 is operated by an actuator such as a solenoid operated by electric power. The instruction signal is output from the control device 50 to the actuator of the direction control valve 41. The actuator of the direction control valve 41 moves the spool of the direction control valve 41 based on the instruction signal output from the control device 50.

In addition, similarly to the operation device 40 described in the above-described embodiment, the operation device 40B also includes a right operation lever and a left operation lever. When the right operation lever is operated in the front to back direction, the boom 13 is lowered and raised. When the right operation lever is operated in the left and right direction (the vehicle width direction), the bucket 11 performs the excavating operation and the dumping operation. When the left operation lever is operated in the front to back direction, the arm 12 performs the dumping operation and the excavating operation. When the left operation lever is operated in the left and right direction, the upper swing body 2 swings left and right. In addition, when the left operation lever is operated in the front to back direction, the upper swing body 2 may swing right and left. Then, when the left operation lever is operated in the left and right direction, the arm 12 may perform the dumping operation and the excavating operation.

In addition, FIG. 15 illustrates an example in which the arm cylinder 22 is operated by the operation device 40B. The hydraulic oil is supplied to the cap side oil chamber 20A of the arm cylinder 22 through the oil passage 47A and the hydraulic oil is supplied to the rod side oil chamber 20B through the oil passage 47B. The bucket cylinder 21 has the same configuration as the arm cylinder 22. In the boom cylinder 23, the hydraulic oil is supplied to the cap side oil chamber 20A of the boom cylinder 23 through the oil passage 47B and the hydraulic oil is supplied to the rod side oil chamber 20B through the oil passage 47B.

In addition, in the above-described embodiment, the leveling assist control is performed based on the local coordinate system. The leveling assist control may be performed based on the global coordinate system.

In addition, in the above-described embodiment, the operation device 40 is provided in the excavator 100. The operation device 40 may be provided in a remote place separated from the excavator 100 so as to remotely operate the excavator 100. When the working implement 1 is operated remotely, the instruction signal indicating the operation amount of the working implement 1 is wirelessly transmitted from the operation device 40 provided in a remote plate to the excavator 100. The operation amount acquiring unit 56 of the control device 50 acquires the wirelessly transmitted instruction signal indicating the operation amount.

In addition, in the above-described embodiment, the excavator 100 is operated by the operation of the operation device 40 by the operator. The control device 50 of the excavator 100 may autonomically control the working implement 1 based on the target excavating topography data regardless of the operation of the operator. When the working implement 1 is autonomically controlled, the operation amount data for autonomically controlling the working implement 1 is wirelessly transmitted from, for example, a computer system provided in a remote place. The operation amount acquiring unit 56 of the control device 50 acquires the wirelessly transmitted operation amount data.

In addition, in the above-described embodiment, the work machine 100 is set as the excavator 100. The control device 50 and the control method described in the above-described embodiment can be applied to the entire work machine including a working implement other than the excavator 100.

REFERENCE SIGNS LIST

1 WORKING IMPLEMENT
2 VEHICLE BODY (UPPER SWING BODY)
3 TRAVELING DEVICE (LOWER TRAVELING BODY)

4 CAB
4S DRIVER SEAT
5 MACHINE ROOM
6 HANDRAIL
7 CRAWLER
10 BLADE TIP
11 BUCKET
12 ARM
13 BOOM
14 BUCKET CYLINDER STROKE SENSOR
15 ARM CYLINDER STROKE SENSOR
16 BOOM CYLINDER STROKE SENSOR
20 HYDRAULIC CYLINDER
20A CAP SIDE OIL CHAMBER
20B ROD SIDE OIL CHAMBER
21 BUCKET CYLINDER
22 ARM CYLINDER
23 BOOM CYLINDER
30 POSITION DETECTOR
31 VEHICLE BODY POSITION DETECTOR
31A GPS ANTENNA
32 POSTURE DETECTOR
33 DIRECTION DETECTOR
34 BLADE TIP POSITION DETECTOR
40 OPERATION DEVICE
41 DIRECTION CONTROL VALVE
42 MAIN HYDRAULIC PUMP
43 PILOT HYDRAULIC PUMP
44A, 44B, 44C OIL PASSAGE
45A, 45B, 45C CONTROL VALVE
46A, 46B PRESSURE SENSOR
47A, 47B OIL PASSAGE
48 SHUTTLE VALVE
49 OPERATION AMOUNT SENSOR
50 CONTROL DEVICE
51 VEHICLE BODY POSITION DATA ACQUIRING UNIT
52 BLADE TIP POSITION DATA ACQUIRING UNIT
53 TARGET EXCAVATING TOPOGRAPHY DATA GENERATING UNIT
54 DISTANCE ACQUIRING UNIT
55 TARGET BLADE TIP SPEED DETERMINING UNIT
56 OPERATION AMOUNT ACQUIRING UNIT
57 TARGET BOOM SPEED CALCULATING UNIT
58 CORRECTION AMOUNT CALCULATING UNIT
59 CORRECTION AMOUNT LIMITING UNIT
60 WORKING IMPLEMENT CONTROL UNIT
61 STORAGE UNIT
62 INPUT/OUTPUT UNIT
70 TARGET CONSTRUCTION DATA GENERATING DEVICE
100 EXCAVATOR
200 CONTROL SYSTEM
300 HYDRAULIC SYSTEM
AX1 ROTATION AXIS
AX2 ROTATION AXIS
AX3 ROTATION AXIS
L11 LENGTH
L12 LENGTH
L13 LENGTH
Pb ABSOLUTE POSITION OF BLADE TIP
Pg ABSOLUTE POSITION OF VEHICLE BODY
RX SWING AXIS
θ11 INCLINATION ANGLE
θ12 INCLINATION ANGLE
θ13 INCLINATION ANGLE

The invention claimed is:

1. A work machine control device for a work machine including a working implement with a boom, an arm, and a bucket with a blade tip, comprising:

a distance acquiring unit which acquires distance data between the bucket and a target excavating topography;

a target blade tip speed determining unit which determines a target blade tip speed of the bucket based on the distance data;

an operation amount acquiring unit which acquires an operation amount for operating the working implement;

a target boom speed calculating unit which calculates a target boom speed based on the target blade tip speed and at least one of an arm operation amount and a bucket operation amount acquired by the operation amount acquiring unit;

a correction amount calculating unit which calculates a correction amount of the target boom speed based on an integration in time of a distance between the bucket and the target excavating topography;

a correction amount limiting unit which limits the correction amount based on the distance between the bucket and the target excavating topography; and a working implement control unit which outputs an instruction for driving a boom cylinder driving the boom based on the target boom speed corrected by the correction amount wherein the working imlement control unit prevents the blade tip of the bucket from being raised until the blade tip of the bucket returns to the target excavating topography from the state where the blade tip digs the target excavating topography.

2. The work machine control device according to claim 1, wherein the working implement control unit outputs an instruction for driving the boom cylinder to raise the boom so that a blade tip of the bucket returns to the target excavating topography from a state where the target excavating topography is dug by the blade tip of the bucket, and wherein the correction amount limiting unit limits the correction amount in a raising operation of the boom.

3. The work machine control device according to claim 1, wherein the correction amount limiting unit calculates an upper limit of the correction amount based on the distance, and wherein the working implement control unit outputs the instruction for driving the boom cylinder based on the upper limit when the correction amount calculated by the correction amount calculating unit is larger than the upper limit calculated by the correction amount limiting unit and outputs the instruction for driving the boom cylinder based on the correction amount when the correction amount is equal to or smaller than the upper limit.

4. The work machine control device according to claim 1, wherein the correction amount limiting unit decreases an upper limit of the correction amount as the distance decreases.

5. The work machine control device according to claim 1, wherein the correction amount limiting unit changes an upper limit of the correction amount based on the arm operation amount or a speed of the arm.

6. The work machine control device according to claim 1, wherein the correction amount limiting unit changes an upper limit of the correction amount based on a weight of the bucket.

7. The work machine control device according to claim 1, wherein the correction amount limiting unit calculates an upper limit of the correction amount based on the target blade tip speed, and wherein the upper limit decreases as the target blade tip speed decreases.

8. A work machine comprising:

a working implement which includes a boom, an arm, and a bucket with a blade tip;

a boom cylinder which drives the boom;

an arm cylinder which drives the arm;

a bucket cylinder which drives the bucket;

an upper swing body which supports the working implement;

a lower traveling body which supports the upper swing body; and a control device, wherein the control device includes a distance acquiring unit which acquires distance data between the bucket and a target excavating topography, a target blade tip speed determining unit which determines a target blade tip speed of the bucket based on the distance data, an operation amount acquiring unit which acquires an operation amount for operating the working implement, a target boom speed calculating unit which calculates a target boom speed based on the target blade tip speed and at least one of an arm operation amount and a bucket operation amount acquired by the operation amount acquiring unit, a correction amount calculating unit which calculates a correction amount of the target boom speed based on an integration in time of a distance between the bucket and the target excavating topography, a correction amount limiting unit which limits the correction amount based on the distance between the bucket and the target excavating topography, and a working implement control unit which outputs an instruction for driving the boom cylinder based on the target boom speed corrected by the correction amount wherein the working implement control unit prevents the blade tip of the bucket from being raised until the blade tip of the bucket returns to the target excavating topography from the state where the blade tip digs the target excavating topography.

9. A method of controlling a work machine including a working implement with a boom, an arm, a bucket with a blade tip, and a control device including a processor for performing the steps comprising:

acquiring distance data between the bucket and a target excavating topography;

determining a target blade tip speed of the bucket based on the distance data;

calculating a target boom speed based on the target blade tip speed and at least one of an arm operation amount and a bucket operation amount;

calculating a correction amount of the target boom speed based on an integration in time of a distance between the bucket and the target excavating topography;

limiting the correction amount based on the distance between the bucket and the target excavating topography;

outputting an instruction for driving a boom cylinder driving the boom based on the target boom speed corrected by the correction amount and driving the boom cylinder based on the instruction wherein the blade tip of the bucket is prevented from being raised until the blade tip of the bucket returns to the target excavating topography from the state where the blade tip digs the target excavating topography.

* * * * *